US008162423B2

(12) United States Patent
Chiwata

(10) Patent No.: US 8,162,423 B2
(45) Date of Patent: Apr. 24, 2012

(54) INKJET RECORDING METHOD AND APPARATUS

(75) Inventor: Yuhei Chiwata, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 431 days.

(21) Appl. No.: 12/493,769

(22) Filed: Jun. 29, 2009

(65) Prior Publication Data

US 2009/0322805 A1 Dec. 31, 2009

(30) Foreign Application Priority Data

Jun. 30, 2008 (JP) ..... 2008-171029

(51) Int. Cl.
*B41J 29/38* (2006.01)

(52) U.S. Cl. ..... 347/6

(58) Field of Classification Search ..... 347/96, 347/100–103, 105; 428/32.1, 195
See application file for complete search history.

(56) References Cited

U.S. PATENT DOCUMENTS 6,341,854 B1 1/2002 Takemoto
6,786,588 B2 9/2004 Koyano et al.
7,033,013 B2 4/2006 Koyano et al.
7,364,266 B2 * 4/2008 Konno ..... 347/43
2008/0241398 A1 * 10/2008 Kato et al. ..... 427/288

FOREIGN PATENT DOCUMENTS

JP 2000-37942 A 2/2000
JP 2002-79739 A 3/2002
JP 2004-10633 A 1/2004
JP 2006-315206 A 11/2006
JP 2007-161753 A 6/2007

* cited by examiner

*Primary Examiner* — Stephen Meier
*Assistant Examiner* — Tracey McMillion
(74) *Attorney, Agent, or Firm* — Birch, Stewart, Kolasch & Birch, LLP

(57) ABSTRACT

The inkjet recording method includes: a treatment liquid deposition step of depositing a treatment liquid containing an aggregating agent onto a surface of a coating layer of a coated paper having a base paper layer and the coating layer coating the base paper layer; and an ink deposition step of depositing ink onto the surface of the coating layer on which the treatment liquid has been deposited. In the ink deposition step, the ink is deposited onto the surface of the coating layer in a state where an effective pH of the aggregating agent on the surface of the coating layer is not lower than 1.67 and not higher than 7.0, and an effective pH of the aggregating agent in the coating layer is not lower than 0.1 and not higher than 1.7.

6 Claims, 10 Drawing Sheets

FIG.6

| TEST NO. | DEPOSITION AMOUNT OF TREATMENT LIQUID (g/m2) | CONCENTRATION OF AGGREGATING AGENT (WT%) | TIME FROM DEPOSITION UNTIL DRYING OF TREATMENT LIQUID (PERMEATION TIME) (SEC) | AMOUNT OF AGGREGATING AGENT ON SURFACE OF COATING LAYER (g/m2) | AMOUNT OF AGGREGATING AGENT INSIDE COATING LAYER (g/m2) | AMOUNT OF AGGREGATING AGENT IN BASE PAPER LAYER (g/m2) | EFFECTIVE pH OF AGGREGATING AGENT ON SURFACE OF COATING LAYER | EFFECTIVE pH OF AGGREGATING AGENT INSIDE COATING LAYER | EFFECTIVE pH OF AGGREGATING AGENT IN BASE PAPER LAYER | DOT DIAMETER (μm) | DOT DIAMETER | CHANGE IN GLOSSINESS | IMAGE RESOLUTION | DRYING TIME | ADHESIVENESS | YELLOWING OF PAPER |
|---|---|---|---|---|---|---|---|---|---|---|---|---|---|---|---|---|
| 01 | 2.5 | 0.10 | 1.0 | 0.005 | 0.208 | 0.001 | 1.84 | 1.45 | 2.94 | 30.0 | GOOD | GOOD | GOOD | GOOD | GOOD | GOOD |
| 02 | 2.5 | 0.10 | 2.0 | 0.004 | 0.160 | 0.104 | 2.61 | 1.53 | 1.65 | 30.1 | GOOD | GOOD | GOOD | GOOD | GOOD | GOOD |
| 03 | 2.5 | 0.10 | 3.0 | 0.007 | 0.102 | 0.154 | 2.45 | 1.66 | 1.54 | 30.1 | GOOD | GOOD | GOOD | GOOD | GOOD | GOOD |
| 04 | 2.5 | 0.10 | 4.0 | 0.007 | 0.056 | 0.210 | 2.47 | 1.84 | 1.45 | 30.1 | GOOD | GOOD | FAIR | GOOD | GOOD | GOOD |
| 05 | 2.5 | 0.10 | 5.0 | 0.001 | 0.004 | 0.257 | 3.02 | 2.62 | 1.39 | 30.1 | GOOD | GOOD | POOR | GOOD | POOR | POOR |
| 06 | 2.5 | 0.20 | 1.0 | 0.109 | 0.408 | 0.009 | 1.64 | 1.25 | 2.40 | 29.5 | GOOD | GOOD | GOOD | GOOD | GOOD | GOOD |
| 07 | 2.5 | 0.20 | 2.0 | 0.006 | 0.309 | 0.203 | 2.51 | 1.33 | 1.46 | 30.1 | GOOD | GOOD | GOOD | GOOD | GOOD | GOOD |
| 08 | 2.5 | 0.20 | 3.0 | 0.003 | 0.209 | 0.302 | 2.73 | 1.45 | 1.34 | 30.1 | GOOD | GOOD | GOOD | GOOD | GOOD | POOR |
| 09 | 2.5 | 0.20 | 4.0 | 0.007 | 0.104 | 0.408 | 2.44 | 1.65 | 1.25 | 30.1 | GOOD | GOOD | GOOD | GOOD | GOOD | POOR |
| 10 | 2.5 | 0.20 | 5.0 | 0.009 | 0.004 | 0.501 | 2.39 | 2.60 | 1.19 | 30.1 | GOOD | GOOD | POOR | GOOD | POOR | POOR |
| 11 | 3.5 | 0.10 | 1.0 | 0.159 | 0.210 | 0.009 | 1.53 | 1.45 | 2.39 | 27.6 | FAIR | FAIR | GOOD | FAIR | GOOD | GOOD |
| 12 | 3.5 | 0.10 | 2.0 | 0.005 | 0.253 | 0.106 | 2.57 | 1.39 | 1.65 | 30.1 | GOOD | GOOD | GOOD | GOOD | GOOD | GOOD |
| 13 | 3.5 | 0.10 | 3.0 | 0.003 | 0.204 | 0.151 | 2.70 | 1.46 | 1.54 | 30.1 | GOOD | GOOD | GOOD | GOOD | GOOD | GOOD |

FIG.6 (CONTINUED)

| TEST NO. | DEPOSITION AMOUNT OF TREATMENT LIQUID (g/m2) | CONCENTRATION OF AGGREGATING AGENT (WT%) | TIME FROM DEPOSITION UNTIL DRYING OF TREATMENT LIQUID (PERMEATION TIME) (SEC) | AMOUNT OF AGGREGATING AGENT ON SURFACE OF COATING LAYER (g/m2) | AMOUNT OF AGGREGATING AGENT INSIDE COATING LAYER (g/m2) | AMOUNT OF AGGREGATING AGENT IN BASE PAPER LAYER (g/m2) | EFFECTIVE pH OF AGGREGATING AGENT ON SURFACE OF COATING LAYER | EFFECTIVE pH OF AGGREGATING AGENT INSIDE COATING LAYER | EFFECTIVE pH OF AGGREGATING AGENT IN BASE PAPER LAYER | DOT DIAMETER (μm) | DOT DIAMETER | CHANGE IN GLOSSINESS | IMAGE RESOLUTION | DRYING TIME | ADHESIVENESS | YELLOWING OF PAPER |
|---|---|---|---|---|---|---|---|---|---|---|---|---|---|---|---|---|
| 14 | 3.5 | 0.10 | 4.0 | 0.002 | 0.155 | 0.201 | 2.85 | 1.54 | 1.46 | 30.1 | GOOD | GOOD | GOOD | GOOD | GOOD | GOOD |
| 15 | 3.5 | 0.10 | 5.0 | 0.006 | 0.108 | 0.260 | 2.48 | 1.64 | 1.38 | 30.1 | GOOD | GOOD | GOOD | GOOD | GOOD | POOR |
| 16 | 3.5 | 0.20 | 1.0 | 0.302 | 0.409 | 0.002 | 1.34 | 1.25 | 2.86 | 26.1 | POOR | POOR | GOOD | GOOD | POOR | GOOD |
| 17 | 3.5 | 0.20 | 2.0 | 0.004 | 0.507 | 0.203 | 2.65 | 1.18 | 1.46 | 30.1 | GOOD | GOOD | GOOD | GOOD | GOOD | GOOD |
| 18 | 3.5 | 0.20 | 3.0 | 0.009 | 0.404 | 0.308 | 2.39 | 1.25 | 1.33 | 30.1 | GOOD | GOOD | GOOD | GOOD | GOOD | POOR |
| 19 | 3.5 | 0.20 | 4.0 | 0.007 | 0.301 | 0.408 | 2.45 | 1.34 | 1.25 | 30.1 | GOOD | GOOD | GOOD | GOOD | GOOD | POOR |
| 20 | 3.5 | 0.20 | 5.0 | 0.008 | 0.205 | 0.501 | 2.42 | 1.45 | 1.19 | 30.1 | GOOD | GOOD | GOOD | GOOD | GOOD | POOR |
| 21 | 5.0 | 0.20 | 1.0 | 0.608 | 0.405 | 0.008 | 1.13 | 1.25 | 2.42 | 26.0 | POOR | POOR | GOOD | GOOD | POOR | GOOD |
| 22 | 5.0 | 0.20 | 2.0 | 0.304 | 0.506 | 0.204 | 1.34 | 1.18 | 1.45 | 26.1 | POOR | POOR | GOOD | GOOD | POOR | GOOD |
| 23 | 5.0 | 0.20 | 3.0 | 0.205 | 0.509 | 0.309 | 1.45 | 1.18 | 1.33 | 26.6 | POOR | POOR | GOOD | GOOD | POOR | POOR |
| 24 | 5.0 | 0.20 | 4.0 | 0.100 | 0.503 | 0.405 | 1.57 | 1.19 | 1.25 | 29.6 | GOOD | GOOD | GOOD | GOOD | GOOD | POOR |
| 25 | 5.0 | 0.20 | 5.0 | 0.005 | 0.505 | 0.509 | 2.57 | 1.19 | 1.18 | 30.1 | GOOD | GOOD | GOOD | GOOD | GOOD | POOR |

INKJET RECORDING METHOD AND APPARATUS

BACKGROUND OF THE INVENTION

1. Field of the Invention

The present invention relates to an inkjet recording method and an inkjet recording apparatus, and more particularly to an inkjet recording method and an inkjet recording apparatus for forming an image by depositing treatment liquid onto a recording medium and then depositing ink.

2. Description of the Related Art

An inkjet recording apparatus is able to record images of good quality by means of a simple composition, and therefore such apparatuses are widely used as domestic printers for individual use and office printers for commercial use. In the case of office printers for commercial use, in particular, there are increasing demands for higher processing speed and higher image quality.

One known system for carrying out inkjet recording at high speed is a system in which ink is deposited in a single pass method by a page-wide line head. Although this system is capable of high recording speed, it has a problem in that there is little time difference between the landing of adjacent dots and therefore interference (bleeding) between the dots is liable to occur and it is difficult to carry out recording of high definition. Furthermore, if printing onto normal paper (non-coated paper), since the coloring material in the ink permeates deeply into the paper, then there is also a problem in that the image density and the image resolution decline.

As a method for resolving these problems, a method is known in which a treatment liquid is deposited before depositing ink and this treatment liquid is caused to react with the ink. For example, a method is known in which, by depositing a treatment liquid containing an acidic aggregating agent and then depositing pigment particles as a coloring material, the Coulomb repulsion of the pigment particles is neutralized, the particles are caused to aggregate, and the viscosity of the ink liquid is raised (see Japanese Patent Application Publication Nos. 2004-010633 and 2007-161753). According to this method, it is possible to suppress interference between the dots, and it is possible to record with high definition and no density non-uniformities. Moreover, by suppressing permeation of the coloring material of the ink into the paper, it is possible to obtain high image density.

This method has chiefly been developed with the object of printing onto normal paper, and in recent years, there have been demands for printing onto coated printing paper, with the object of printing with higher quality. However, if printing onto coated paper, the print quality varies greatly depending on the deposition conditions of the treatment liquid. For example, if the amount of aggregating agent present on the surface of the paper is excessively large, then the spread of the ink dots formed by the deposited ink droplets is suppressed and there is a problem in that it is not possible to form a solid image. Furthermore, if using an acidic aggregating agent, yellowing of the paper occurs when the amount of aggregating agent permeating into the base paper layer is excessively large.

In order to resolve these problems, various methods have been proposed. For example, Japanese Patent Application Publication No. 2000-037942 discloses heating and pressing the medium after depositing treatment liquid, thereby a large amount of aggregating agent is left on the surface of the paper and the reaction efficiency is thus improved, while wrinkles in the paper is suppressed. Japanese Patent Application Publication No. 2002-079739 discloses leaving a large amount of aggregating agent on the surface of the paper, thereby improving the reaction efficiency, by using a treatment liquid of high viscosity. Japanese Patent Application Publication No. 2006-315206 discloses stabilizing the state of the treatment liquid and stabilizing the image quality, by providing a device for adjusting the permeated volume, permeability and deposition volume of the treatment liquid.

However, none of the related documents describes specifically in what state the droplets of ink should be deposited. In the related art, if droplets of ink are deposited after depositing treatment liquid onto a coated paper, then there are possible problems, such as reduced diameter of the ink dots, decline in glossiness, landing interference (decline of image resolution), and extended drying time.

SUMMARY OF THE INVENTION

The present invention has been contrived in view of these circumstances, an object thereof being to provide an inkjet recording method and an inkjet recording apparatus whereby it is possible to prevent the occurrence of problems, such as reduction in the diameter of the ink dots, decline in glossiness, landing interference, extended drying time, even if treatment liquid and ink are deposited separately onto a coated paper.

In order to attain the aforementioned object, the present invention is directed to an inkjet recording method, comprising: a treatment liquid deposition step of depositing a treatment liquid containing an aggregating agent onto a surface of a coating layer of a coated paper having a base paper layer and the coating layer coating the base paper layer; and an ink deposition step of depositing ink onto the surface of the coating layer on which the treatment liquid has been deposited, wherein in the ink deposition step, the ink is deposited onto the surface of the coating layer in a state where an effective pH of the aggregating agent on the surface of the coating layer is not lower than 1.67 and not higher than 7.0, and an effective pH of the aggregating agent in the coating layer is not lower than 0.1 and not higher than 1.7.

The inventor discovered that the various problems occurring when treatment liquid and ink are deposited in this order on coated paper are caused by the amount of the aggregating agent present on the surface of the coating layer of the coated paper or inside the coating layer of the coated paper when the ink is deposited. More specifically, if the amount of the aggregating agent present on the surface of the coating layer of the coated paper is too large (in other words, if the effective pH of the aggregating agent is too low), then the aggregating reaction proceeds before the ink dot spreads sufficiently and hence the diameter of the ink dots becomes smaller and excess aggregating agent precipitates on the surface of the coating layer thus giving rise to decline in glossiness. If, on the contrary, the amount of the aggregating agent present on the surface of the coating layer of the coated paper or inside the coating layer of the coated paper is too small (in other words, if the effective pH of the aggregating agent is too high), then the supply of the aggregating agent to the ink is slow, and there is a problem in that landing interference occurs and the drying time is extended. Moreover, the inventor discovered, as an amount of the aggregating agent (the effective pH value) capable of preventing the occurrence of these problems, an effective pH of 1.67 or higher and 7.0 or lower of the aggregating agent on the surface of the coating layer of the coated paper, and an effective pH of 0.1 or higher and 1.7 or lower of the aggregating agent inside the coating layer. The present invention has been contrived on the basis of these findings and is able to prevent problems such as reduced diameter of the ink dots, decline in glossiness, landing interference, and extended drying time, since the ink is deposited in a state where the effective pH of the aggregating agent on the surface of the coating layer of the coated paper is 1.67 or higher and 7.0 or lower and the effective pH of the aggregating agent inside the coating layer is 1.7 or lower.

As a method of depositing the ink in this state, it is possible to control the time from the deposition of the treatment liquid until the ejection and deposition of droplets of the ink, or to control a drying device which dries the treatment liquid.

In the present invention, the effective pH which acts on the aggregation of ink is defined as the pH of the liquid obtained by dissolving the amount of the aggregating agent present in each layer in an aqueous solvet equivalent to the amount of primary color ink.

Preferably, in the ink deposition step, the ink is deposited onto the surface of the coating layer in a state where an effective pH of the aggregating agent in the base paper layer of the coated paper is not lower than 1.4 and not higher than 7.0.

According to this aspect of the present invention, it is possible to prevent the coated paper from yellowing. If the effective pH of the aggregating agent in the base paper layer is lower than 1.4, then yellowing occurs with temporal change.

Preferably, the method further comprises a heating and drying step of heating and drying a solvent of the ink deposited in the ink deposition step.

According to this aspect of the present invention, since the solvent in the ink is dried by heating, then it is possible to improve the adhesiveness between the ink and the coated paper, as well as being able to improve drying efficiency.

Preferably, the method further comprises a fixing step of fixing the ink that has been heated and dried in the heating and drying step, onto the coating layer by heat.

According to this aspect of the present invention, by fixing by heat, it is possible to raise the adhesiveness between the ink and the recording medium (coated paper).

In order to attain the aforementioned object, the present invention is also directed to an inkjet recording apparatus, comprising: a treatment liquid deposition device which deposits a treatment liquid containing an aggregating agent onto a surface of a coating layer of a coated paper having a base paper layer and the coating layer coating the base paper layer; and an ink deposition device which deposits ink onto the surface of the coating layer on which the treatment liquid has been deposited, wherein the ink deposition device deposits the ink onto the surface of the coating layer in a state where an effective pH of the aggregating agent on the surface of the coating layer is not lower than 1.67 and not higher than 7.0, and an effective pH of the aggregating agent in the coating layer is not lower than 0.1 and not higher than 1.7.

According to this aspect of the present invention, it is possible to prevent problems such as reduced diameter of the ink dots, decline in glossiness, landing interference, and extended drying time.

Preferably, the ink deposition device deposits the ink onto the surface of the coating layer in a state where an effective pH of the aggregating agent in the base paper layer of the coated paper is not lower than 1.4 and not higher than 7.0.

Preferably, the apparatus further comprises a heating and drying device which heats and dries a solvent of the ink deposited by the ink deposition device.

Preferably, the apparatus further comprises a fixing device which fixes the ink that has been heated and dried by the heating and drying device, onto the coating layer by heat.

In order to attain the aforementioned object, the present invention is also directed to an inkjet recording method, comprising: a treatment liquid deposition step of depositing a treatment liquid containing an aggregating agent onto a surface of a coating layer of a coated paper having a base paper layer and the coating layer coating the base paper layer; and an ink deposition step of depositing ink onto the surface of the coating layer on which the treatment liquid has been deposited, wherein in the ink deposition step, the ink is deposited onto the surface of the coating layer in a state where an amount of the aggregating agent on the surface of the coating layer is 0 g/m$^2$ or more and 0.1 g/m$^2$ or less, and an amount of the aggregating agent in the coating layer is 0.1 g/m$^2$ or more and 2.0 g/m$^2$ or less.

According to this aspect of the present invention, the above-described effective pH of the aggregating agent is expressed using the amount of the aggregating agent, and it is also possible to prevent problems such as reduced diameter of the ink dots, decline in glossiness, landing interference, and extended drying time.

Preferably, in the ink deposition step, the ink is deposited onto the surface of the coating layer in a state where an amount of the aggregating agent in the base paper layer of the coated paper is 0 g/m$^2$ or more and 0.21 g/m$^2$ or less.

According to this aspect of the present invention, it is possible to prevent the coated paper from yellowing. If the amount of the aggregating agent in the base paper layer is more than 0.21 g/m$^2$, then yellowing occurs with temporal change.

According to the present invention, since the ink is deposited in a state where the effective pH of the aggregating agent on the surface of the coating layer of the coated paper is not lower than 1.67 and not higher than 7.0, and the effective pH of the aggregating agent inside the coating layer of the coated paper is not lower than 0.1 and not higher than 1.7, or since the ink is deposited in a state where the amount of the aggregating agent on the surface of the coating layer of the coated paper is 0 g/m$^2$ or more and 0.1 g/m$^2$ or less and the amount of the aggregating agent inside the coating layer of the coated paper is 0.1 g/m$^2$ or more and 2.0 g/m$^2$ or less, it is possible to prevent problems such as reduced diameter of the ink dots, decline in glossiness, landing interference, and extended drying time.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 6 is a table showing the experiment results;

DETAILED DESCRIPTION OF THE PREFERRED EMBODIMENTS

Figure 1:
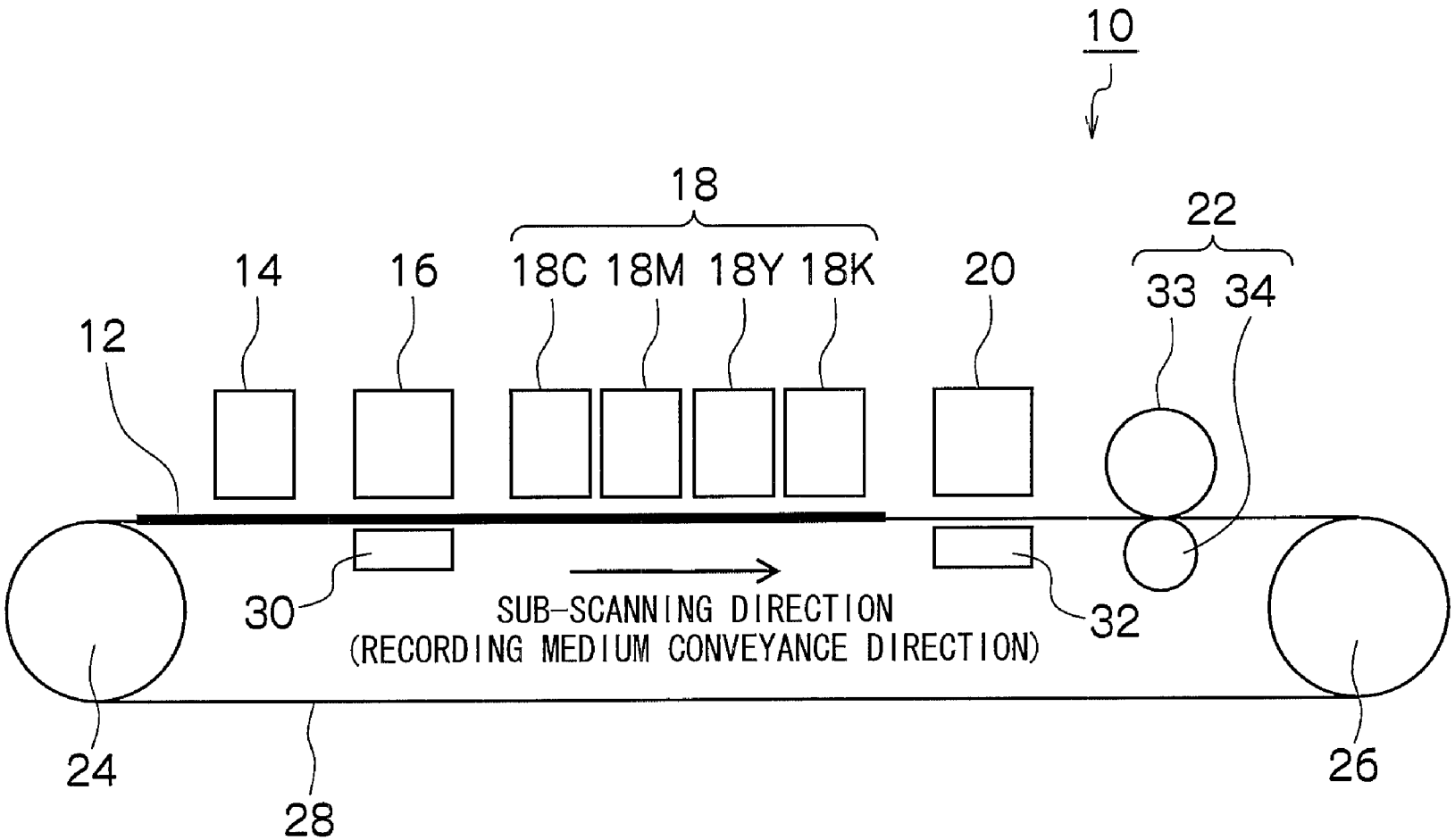
FIG. 1 is a schematic drawing of an image forming apparatus according to an embodiment of the present invention.

Firstly, the ink and the treatment liquid used in an embodiment of the present invention will be described.

Ink

The ink used in the present embodiment is aqueous pigment ink that contains the following materials insoluble to the solvent (water): pigment particles as the coloring material, and polymer particles.

It is desirable that the concentration of the solvent-insoluble materials in the ink is not less than 1 wt % and not more than 20 wt %, taking account of the fact that the viscosity of the ink suitable for ejection is 20 mPa·s or lower. It is more desirable that the concentration of the pigment in the ink is not less than 4 wt %, in order to obtain good optical density in the image. It is desirable that the surface tension of the ink is not less than 20 mN/m and not more than 40 mN/m, taking account of ejection stability in the ink ejection head.

The coloring material in the ink may be pigment or a combination of pigment and dye. From the viewpoint of the aggregating characteristics when the ink comes into contact with the treatment liquid, a dispersed pigment in the ink is desirable for more effective aggregation. Desirable pigments include: a pigment dispersed by a dispersant, a self-dispersing pigment, a pigment in which the pigment particle is coated with a resin (hereinafter referred to as "microcapsule pigment"), and a polymer grafted pigment. Moreover, from the viewpoint of the aggregating characteristics of the coloring material, it is more desirable that the coloring material is modified with a carboxyl group having a low degree of dissociation.

There are no particular restrictions on the resin used for a microcapsule pigment, but desirably, it should be a compound of high molecular weight which has a self-dispersing capability or solubility in water, and contains an anionic group (acidic). Generally, it is desirable that the resin should have a number average molecular weight in the approximate range of 1,000 to 100,000, and especially desirably, in the approximate range of 3,000 to 50,000. Moreover, desirably, this resin can dissolved in an organic solvent to form a solution. By limiting the number average molecular weight of the resin to this range, it is possible to make the resin display satisfactory functions as a covering film for the pigment particle, or as a coating film in the ink composition.

The resin may itself have a self-dispersing capability or solubility, or these functions may be added or introduced. For example, it is possible to use a resin having an introduced carboxyl group, sulfonic acid group, or phosphonic acid group or another anionic group, by neutralizing with an organic amine or alkali metal. Moreover, it is also possible to use a resin into which one or two or more anionic groups of the same type or different types have been introduced. In the embodiment of the present invention, it is desirable to use a resin which has been neutralized by means of a salt and which contains an introduced carboxyl group.

There are no particular restrictions on the pigment used in the present embodiment, and specific examples of orange and yellow pigments are: C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 128, C. I. Pigment Yellow 138, C. I. Pigment Yellow 151, C. I. Pigment Yellow 155, C. I. Pigment Yellow 180, and C.I. Pigment Yellow 185.

Specific examples of red and magenta pigments are: C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, and C.I. Pigment Red 222.

Specific examples of green and cyan pigments are: C. I. Pigment Blue 15, C. I. Pigment Blue 15:2, C. I. Pigment Blue 15:3, C. I. Pigment Blue 16, C. I. Pigment Blue 60, and C.I. Pigment Green 7.

Specific examples of a black pigment are: C.I. Pigment Black 1, C.I. Pigment Black 6, and C.I. Pigment Black 7.

It is desirable in the present embodiment that the ink contains polymer particles that do not contain any colorant, as a component for reacting with the treatment liquid. The polymer particles can improve the image quality by strengthening the ink viscosity raising action and the aggregating action through reaction with the treatment liquid. In particular, a highly stable ink can be obtained by adding anionic polymer particles to the ink.

By using the ink containing the polymer particles that produce the viscosity raising action and the aggregating action through reaction with the treatment liquid, it is possible to increase the quality of the image, and at the same time, depending on the type of polymer particles, the polymer particles may form a film on the recording medium, and therefore beneficial effects can be obtained in improving the wear resistance and the waterproofing characteristics of the image.

The method of dispersing the polymer particles in the ink is not limited to adding an emulsion of the polymer particles to the ink, and the resin may also be dissolved, or included in the form of a colloidal dispersion, in the ink.

The polymer particles may be dispersed by using an emulsifier, or the polymer particles may be dispersed without using any emulsifier. For the emulsifier, a surface active agent of low molecular weight is generally used, and it is also possible to use a surface active agent of high molecular weight. It is also desirable to use a capsule type of polymer particles having an outer shell composed of acrylic acid, methacrylic acid, or the like (core-shell type of polymer particles in which the composition is different between the core portion and the outer shell portion).

The polymer particles dispersed without any surface active agent of low molecular weight are known as the soap-free latex, which includes polymer particles with no emulsifier or a surface active agent of high molecular weight. For example, the soap-free latex includes polymer particles that use, as an emulsifier, the above-described polymer having a water-soluble group, such as a sulfonic acid group or carboxylic acid group (a polymer with a grafted water-soluble group, or a block polymer obtained from a monomer having a water-soluble group and a monomer having an insoluble part).

It is especially desirable in the present embodiment to use the soap-free latex compared to other type of resin particles obtained by polymerization using an emulsifier, since there is no possibility that the emulsifier inhibits the aggregating reaction and film formation of the polymer particles, or that the free emulsifier moves to the surface after film formation of the polymer particles and thereby degrades the adhesive properties between the recording medium and the ink aggregate in which the coloring material and the polymer particles are combined.

Examples of the resin component added as the resin particles to the ink include: an acrylic resin, a vinyl acetate resin, a styrene-butadiene resin, a vinyl chloride resin, an acrylstyrene resin, a butadiene resin, and a styrene resin.

In order to make the polymer particles have high speed aggregation characteristics, it is desirable that the polymer particles contain a carboxylic acid group having a low degree of disassociation. Since the carboxylic acid group is readily affected by change of pH, then the polymer particles containing the carboxylic acid group easily change the state of the dispersion and have high aggregation characteristics.

The change in the dispersion state of the polymer particles caused by change in the pH can be adjusted by means of the component ratio of the polymer particle having a carboxylic acid group, such as ester acrylate, or the like, and it can also be adjusted by means of an anionic surfactant which is used as a dispersant.

Desirably, the resin constituting the polymer particles is a polymer that has both of a hydrophilic part and a hydrophobic part. By incorporating a hydrophobic part, the hydrophobic part is oriented toward to the inner side of the polymer particle, and the hydrophilic part is oriented efficiently toward the outer side, thereby having the effect of further increasing the change in the dispersion state caused by change in the pH of the liquid. Therefore, aggregation can be performed more efficiently.

Examples of commercially available resin emulsion include: Joncryl 537 and 7640 (styrene-acrylic resin emulsion, manufactured by Johnson Polymer), Microgel E-1002 and E-5002 (styrene-acrylic resin emulsion, manufactured by Nippon Paint), Voncoat 4001 (acrylic resin emulsion, manufactured by Dainippon Ink and Chemicals), Voncoat 5454 (styrene-acrylic resin emulsion, manufactured by Dainippon Ink and Chemicals), SAE-1014 (styrene-acrylic resin emulsion, manufactured by Zeon Japan), Jurymer ET-410 (acrylic resin emulsion, manufactured by Nihon Junyaku), Aron HD-5 and A-104 (acrylic resin emulsion, manufactured by Toa Gosei), Saibinol SK-200 (acrylic resin emulsion, manufactured by Saiden Chemical Industry), and Zaikthene L (acrylic resin emulsion, manufactured by Sumitomo Seika Chemicals). However, the resin emulsion is not limited to these examples.

The weight ratio of the polymer particles to the pigment is desirably 2:1 through 1:10, and more desirably 1:1 through 1:3. If the weight ratio of the polymer particles to the pigment is less than 2:1, then there is no substantial improvement in the aggregating force of the aggregate formed by the cohesion of the polymer particles. On the other hand, if the weight ratio of the polymer particles to the pigment is greater than 1:10, the viscosity of the ink becomes too high and the ejection characteristics, and the like, deteriorate.

From the viewpoint of the adhesive force after the cohesion, it is desirable that the molecular weight of the polymer particles added to the ink is no less than 5,000. If it is less than 5,000, then beneficial effects are insufficient in terms of improving the internal aggregating force of the ink aggregate, achieving good fixing characteristics after transfer to the recording medium, and improving the image quality.

Desirably, the volume-average particle size of the polymer particles is in the range of 10 nm to 1 μm, more desirably, the range of 10 nm to 500 nm, even desirably 20 nm to 200 nm and particularly desirably, the range of 50 nm to 200 nm. If the particle size is equal to or less than 10 nm, then significant effects in improving the image quality or enhancing transfer characteristics cannot be expected, even if aggregation occurs. If the particle size is equal to or greater than 1 μm, then there is a possibility that the ejection characteristics from the ink head or the storage stability will deteriorate. Furthermore, there are no particular restrictions on the volume-average particle size distribution of the polymer particles and they may have a broad volume-average particle size distribution or they may have a monodisperse volume-average particle size distribution.

Moreover, two or more types of polymer particles may be used in combination in the ink.

Examples of the pH adjuster added to the ink in the present embodiment include an organic base and an inorganic alkali base, as a neutralizing agent. In order to improve storage stability of the ink for inkjet recording, the pH adjuster is desirably added in such a manner that the ink for inkjet recording has the pH of 6 through 10.

It is desirable in the present embodiment that the ink contains a water-soluble organic solvent, from the viewpoint of preventing nozzle blockages in the ejection head due to drying. Examples of the water-soluble organic solvent include a wetting agent and a penetrating agent.

Examples of the water-soluble organic solvent in the ink are: polyhydric alcohols, polyhydric alcohol derivatives, nitrous solvents, monohydric alcohols, and sulfurous solvents. Specific examples of the polyhydric alcohols are: ethylene glycol, diethylene glycol, propylene glycol, butylene glycol, triethylene glycol, 1,5-pentane diol, 1,2,6-hexane triol, and glycerin. Specific examples of the derivatives of polyhydric alcohol are: ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and an ethylene oxide adduct of diglycerin. Specific examples of the nitrous solvents are: pyrrolidone, N-methyl-2-pyrrolidone, cyclohexyl pyrrolidone, and triethanol amine. Specific examples of the monohydric alcohols are: ethanol, isopropyl alcohol, butyl alcohol, benzyl alcohol, and the like. Specific examples of the sulfurous solvents are: thio diethanol, thio diglycerol, sulfolane, and dimethyl sulfoxide. Apart from these, it is also possible to use propylene carbonate, ethylene carbonate, or the like.

The ink according to the present embodiment may contain a surfactant.

Examples of the surfactant in the ink include: in a hydrocarbon system, an anionic surfactant, such as a salt of a fatty acid, an alkyl sulfate ester salt, an alkyl benzene sulfonate salt, an alkyl naphthalene sulfonate salt, a dialkyl sulfosuccinate salt, an alkyl phosphate ester salt, a naphthalene sulfonate/formalin condensate, and a polyoxyethylene alkyl sulfonate ester salt; and a non-ionic surfactant, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerin fatty acid ester, and an oxyethylene oxypropylene block copolymer. Desirable examples of the surfactant further include: Surfynols (manufactured by Air Products & Chemicals), which is an acetylene-based polyoxyethylene oxide surfactant, and an amine oxide type of amphoteric surfactant, such as N,N-dimethyl-N-alkyl amine oxide.

Moreover, it is also possible to use the surfactants cited in Japanese Patent Application Publication No. 59-157636, pages 37 to 38, and Research Disclosure No. 308119 (1989). Furthermore, it is also possible to use a fluoride type (alkyl fluoride type), or silicone type of surfactant such as those described in Japanese Patent Application Publication Nos. 2003-322926, 2004-325707 and 2004-309806. It is also possible to use a surface tension adjuster of this kind as an anti-foaming agent; and a fluoride or silicone compound, or a chelating agent, such as ethylenediamine tetraacetic acid (EDTA), can also be used.

The surfactant contained in the ink has beneficial effects in raising the wettability on the solid or semi-solid aggregating treatment agent layer by reducing the surface tension, and therefore the aggregating action effectively progresses due to the increase in the contact surface area between the solid or semi-solid aggregating treatment agent layer and the ink.

It is desirable in the present embodiment that the ink has the surface tension of 10 mN/m through 50 mN/m. Moreover, from the viewpoint of simultaneously achieving good permeability into the permeable recording medium, formation of fine droplets and good ejection properties, it is more desirable that the ink has the surface tension of 15 mN/m through 45 mN/m.

It is desirable in the present embodiment that the ink has the viscosity of 1.0 mPa·s to 20.0 mPa·s.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

Treatment Liquid

It is desirable in the present embodiment that the treatment liquid (aggregating treatment liquid) has effects of generating aggregation of the pigment and the polymer particles contained in the ink by producing a pH change in the ink when coming into contact with the ink.

Specific examples of the contents of the treatment liquid are: polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, derivatives of these compounds, and salts of these.

A treatment liquid having added thereto a polyvalent metal salt or a polyallylamine is the preferred examples of the treatment liquid. The aforementioned compounds may be used individually or in combinations of two or more thereof.

From the standpoint of aggregation ability with the ink, the treatment liquid preferably has a pH of 1 to 6, more preferably a pH of 2 to 5, and even more preferably a pH of 3 to 5.

The amount of the component that causes aggregation of the pigment and polymer particles of the ink in the treatment liquid is preferably not less than 0.01 wt % and not more than 20 wt % based on the total weight of the liquid. Where the amount of this component is less than 0.01 wt %, sufficient concentration diffusion does not proceed when the treatment liquid and ink come into contact with each other, and sufficient aggregation action caused by pH variation sometimes does not occur. Further, where the amount of this component is more than 20 wt %, the ejection ability from the inkjet head can be degraded.

From the standpoint of preventing the nozzles of inkjet heads from being clogged by the dried treatment liquid, it is preferred that the treatment liquid include an organic solvent capable of dissolving water and other additives. A wetting agent and a penetrating agent are included in the organic solvent capable of dissolving water and other additives.

The solvents can be used individually or in a mixture of plurality thereof together with water and other additives.

The content ratio of the organic solvent capable of dissolving water and other additives is preferably not more than 60 wt % based on the total weight of the treatment liquid. Where this amount is higher than 60 wt %, the viscosity of the treatment liquid increases and ejection ability from the inkjet head can be degraded.

In order to improve fixing ability and abrasive resistance, the treatment liquid may further include a resin component. Any resin component may be employed, provided that the ejection ability from a head is not degraded when the treatment liquid is ejected by an inkjet system and also provided that the treatment liquid will have high stability in storage. Thus, water-soluble resins and resin emulsions can be freely used.

An acrylic resin, a urethane resin, a polyester, a vinyl resin, and a styrene resin can be considered as the resin components. In order to demonstrate a sufficient function of improving the fixing ability, a polymer with a comparatively high molecular weight has to be added at a high concentration of 1 wt % to 20 wt %. However, where such a material is added to and dissolved in a liquid, the viscosity thereof increases and ejection ability is degraded. A latex can be effectively added as an adequate material that can be added to a high concentration, while inhibiting the increase in viscosity. Examples of latex materials include alkyl acrylate copolymers, carboxy-modified SBR (styrene-butadiene latex), SIR (styrene-isoprene) latex, MBR (methyl methacrylate-butadiene latex), and NBR (acrylonitrile-butadiene latex). From the standpoint of the process, the glass transition temperature Tg of the latex has a strong effect during fixing, and is desirably not lower than 40° C. and not higher than 120° C. Furthermore, from the standpoint of the process, the minimum film-formation temperature MFT also has a strong effect during fixing, and in order to obtain sufficient fixing at a low temperature, it is preferred that the MFT be not higher than 100° C., more preferably not higher than 50° C.

The aggregation ability may be further improved by introducing polymer microparticles of reverse polarity with respect to that of the ink into the treatment liquid and causing the aggregation of the pigment contained in the ink with the polymer microparticles.

The aggregation ability may be also improved by introducing a curing agent corresponding to the polymer microparticle component contained in the ink into the treatment liquid, bringing the two liquids into contact, causing aggregation and also crosslinking or polymerization of the resin emulsion in the ink component.

The treatment liquid used in the present embodiment can include a surfactant.

Examples of suitable surfactants of a hydrocarbon system include anionic surfactants such as fatty acid salts, alkylsulfuric acid esters and salts, alkylbenzenesulfonic acid salts, alkylnaphthalenesulfonic acid salts, dialkylsulfosuccinic acid salts, alkylphosphoric acid esters and salts, naphthalenesulfonic acid formalin condensate, and polyoxyethylene alkylsulfuric acid esters and salts, and nonionic surfactants such as polyoxyethyelene alkyl ethers, polyoxyethylene alkylallyl ethers, polyoxyethylene fatty acid esters, sorbitan fatty acid esters, polyoxyethylene sorbitan fatty acid esters, polyoxyethylene alkylamines, glycerin fatty acid esters, and oxyethylene oxypropylene block copolymer. It is preferred that SURFYNOLS (made by Air Products & Chemicals), which is an acetylene-type polyoxyethylene oxide surfactant, be used. Amineoxide-type amphoteric surfactant such as N,N-dimethyl-N-alkylamineoxide is also a preferred surfactant.

A surfactant described in Japanese Patent Application Publication No. 59-157636, pages 37 to 38 and Research Disclosure No. 308119 (1989) can be also used. Fluorine-containing (fluorinated alkyl system) and silicone-type surfactants such as described in Japanese Patent Application Publication Nos. 2003-322926, 2004-325707, and 2004-309806 can be also used. These surface tension adjusting agents can be also used as an antifoaming agent. Chelating agents represented by fluorine-containing or silicone-type compounds and EDTA can be also used.

These agents are effective in reducing surface tension and increasing wettability on the recording medium. Further, even when the ink is the first to be deposited, effective aggregation action proceeds because of increased wettability of the ink and enlarged contact surface area of the two liquids.

It is desirable in the present embodiment that the treatment liquid has the surface tension of 10 mN/m through 50 mN/m. Moreover, from the viewpoint of simultaneously achieving good permeability into the permeable recording medium, formation of fine droplets and good ejection properties, it is more desirable that the treatment liquid has the surface tension of 15 mN/m through 45 mN/m.

It is desirable in the present embodiment that the treatment liquid has the viscosity of 1.0 mPa·s to 20.0 mPa·s.

Apart from the foregoing, according to requirements, it is also possible that the treatment liquid contains a pH buffering agent, an anti-oxidation agent, an antibacterial agent, a viscosity adjusting agent, a conductive agent, an ultraviolet absorbing agent, or the like.

Recording Medium

There are no particular restrictions on the recording medium used in the present embodiment; however, particularly desirable results can be obtained with coated printing papers, which have a slow rate of permeation of the ink solvent.

Possible examples of support media (base paper layer) which can be used appropriately for coated paper are: a base paper manufactured using a Fourdrinier paper machine, cylindrical-wire paper machine, twin-wire paper machine, or the like, from main components of wood pulp or pigment, the pulp being either a chemical pulp such as LBKP or NBKP, a mechanical pulp, such as GP, PGW, RMP, TMP, CTMP, CMP, CGP, or the like, or recovered paper pulp, such as DIP, and the main components being mixed with one or more additive of a sizing agent, fixing agent, yield enhancer, cationization agent, paper strength enhancer, or the like, or a base paper provided with a size press layer or anchor coating layer formed using starch, polyvinyl alcohol, or the like, or an art paper, coated paper, or cast coated paper, or the like, formed by providing a coating layer on top of the size press layer or anchor coating layer.

There are no particular restrictions on the weight of the support medium, although generally the weight is approximately 40 g/m$^2$ to 300 g/m$^2$. The coated paper used in the present embodiment has the coating layer formed on the support medium described above. The coating layer includes a coating composition having a main component of pigment and binder, and at least one layer thereof is formed on the support medium.

For the pigment, it is desirable to use a white pigment. Possible examples of the white pigment are: an inorganic pigment, such as precipitated calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic non-crystalline silica, colloidal silica, alumina, colloidal alumina, pseudo-boehmite, aluminum hydroxide, lithopone, zeolite, hydrated halloysite, magnesium hydroxide, or the like; or an organic pigment, such as a styrene-based plastic pigment, an acrylic plastic pigment, polyethylene, microcapsules, urea resin, melamine resin, or the like.

Possible examples of the binder are: a starch derivative, such as oxidized starch, etherified starch, or phosophoric acid esterized starch; a cellulose derivative, such as carboxymethyl cellulose, hydroxyethyl cellulose, or the like; casein, gelatine, soybean protein, polyvinyl alcohol, or derivatives of same; polyvinyl alcohols having various degrees of saponification or silanol-denatured versions of same, or carboxylates, cationized products, of other derivatives of same; polyvinyl pyrrolidone, maleic anhydride resin, a styrene-butadiene copolymer, a methyl methacrylate-butadiene copolymer, or other conjugated diene copolymer latex; an acrylic polymer latex, such as a polymer or copolymer of acrylate ester and methacrylate ester; a vinyl polymer latex, such as such as an ethylene acetate vinyl copolymer; or a functional group-denatured polymer latex based on these various polymers and a monomer containing a functional group such as a carboxy group; an aqueous adhesive of a heat-curable synthetic resin, such as melamine resin, urea resin, or the like; an acrylate ester such as polymethylmethacrylate; methacrylate ester polymer or copolymer resin, such as methacrylate ester; or a synthetic resin-based adhesive, such as polyurethane resin, unsaturated polyester resin, vinyl chloride-vinyl acetate copolymer, polyvinyl butylal, alkyd resin, or the like.

The combination ratio of the pigment and binder in the coating layer is 3 to 70 parts by weight, and desirably 5 to 50 parts by weight, of binder with respect to 100 parts by weight of pigment. If the combination ratio of the binder with respect to 100 parts by weight of pigment is less than 3 parts by weight, then the coating of the ink receiving layer by the coating composition will have insufficient strength. On the other hand, if the combination ratio is greater than 70 parts by weight, then the absorption of high-boiling-point solvent is slowed dramatically.

Moreover, it is also possible to combine various additives in appropriate fashion in the coating layer, such as: a dye fixing agent, a pigment dispersant, a viscosity raising agent, a fluidity enhancer, an antifoaming agent, a foam suppressant, a separating agent, a foaming agent, a permeating agent, a coloring dye, a coloring pigment, a fluorescent brightener, an ultraviolet light absorber, an antioxidant, an anticorrosive, an antibacterial agent, a waterproofing agent, a wet paper strength enhancer, a dry paper strength enhancer, or the like.

The application amount of the ink receiving layer varies depending on the required luster, the ink absorbing properties and the type of support medium, or the like, and although no general figure can be stated, it is normally 1 g/m$^2$ or greater. Furthermore, the ink receiving layer can also be applied by dividing a certain uniform application amount into two application steps. If application is divided into two steps in this way, then the luster is raised in comparison with a case where the same application amount is applied in one step.

The application of the coating layer can be carried out using one of various types of apparatus, such as a blade coater, roll coater, air knife coater, bar coater, rod blade coater, curtain coater, short dowel coater, size press, or the like, in on-machine or off-machine mode. Furthermore, after application of the coating layer, it is also possible to carry out a smoothing and finishing process on the ink receiving layer by using a calender apparatus, such as a machine calender, a TG calender, a soft calender, or the like.

The number of coating layers can be determined appropriately in accordance with requirements.

The coating paper may be an art paper, high-quality coated paper, medium-quality coated paper, high-quality lightweight coated paper, medium-quality lightweight coated paper, or light-coated printing paper; the application amount of the coating layer is around 40 g/m$^2$ on both surfaces in the case of art paper, around 20 g/m$^2$ on both surfaces in the case of high-quality coated paper or medium-quality coated paper, around 15 g/m$^2$ on both surfaces in the case of high-quality lightweight coated paper or medium-quality lightweight coated paper, and 12 g/m$^2$ or less on both surfaces in the case of a light-coated printing paper. An example of an art paper is Tokubishi Art, or the like; an example of a high-quality coated paper is "Urite"; examples of art papers are Tokubishi Art (made by Mitsubishi Paper Mills), Golden Cask Satin (made by Oji Paper), or the like; examples of coated papers are OK Top Coat (made by Oji Paper), Aurora Coat (made by Nippon Paper Group), Recycle Coat T-6 (made by Nippon Paper Group); examples of lightweight coated papers are Urite (made by Nippon Paper Group), New V Matt (made by Mitsubishi Paper Mills), New Age (made by Oji Paper), Recycle Mat T-6 (made by Nippon Paper Group), and "Pism" (made by Nippon Paper Group). Examples of light-coated printing papers are Aurora L (made by Nippon Paper Group) and Kinmari Hi-L (made by Hokuetsu Paper Mills), or the like. Moreover, examples of cast coated papers are: SA Gold Cask plus (made by Oji Paper), Hi-McKinley Art (Gojo Paper Manufacturing), or the like.

Image Forming Apparatus

With reference to FIG. 1, the fundamental procedure of the image forming method according to an embodiment of the present invention is described. FIG. 1 is a schematic drawing of an image forming apparatus used in an image forming method according to an embodiment of the present invention.

The image forming apparatus (inkjet recording apparatus) 10 shown in FIG. 1 includes, in order from the upstream side in the direction of conveyance of a recording medium 12 (the sub-scanning direction): a treatment liquid deposition unit 14, a treatment liquid drying unit 16, an ink droplet ejection unit 18, an ink drying unit 20, and a fixing unit 22.

The recording medium 12 is held on an endless conveyance belt 28 wound about rollers 24 and 26, and is conveyed from the left-hand side to the right-hand side in the drawing. The conveyance method of the recording medium 12 is not limited in particular to the belt conveyance method shown in FIG. 1, and it is possible to use various methods such as a drum conveyance method where the recording medium 12 is held and conveyed on a surface (circumferential surface) of a drum-shaped member. The drum conveyance method is described later.

The treatment liquid deposition unit 14 deposits the treatment liquid onto the coating layer of the recording medium 12 before the deposition of ink droplets by the ink droplet ejection unit 18, which is arranged to the downstream side in the sub-scanning direction. The treatment liquid deposition unit 14 deposits the treatment liquid at the amount of about 2.5 g/m$^2$ over the whole surface of the coating layer of the recording medium 12. There are no particular restrictions on the method of depositing the treatment liquid, and for example, it is possible to employ an application method using an application roller, or the like, or a spraying method, an inkjet recording method, or other methods of various types. In these, it is desirable to deposit droplets of the treatment liquid on the recording medium through a recording head (inkjet head) of the inkjet recording method, since it is possible to selectively deposit the treatment liquid onto only an area where the ink droplets are deposited, so that the drying duration can be shortened and the required heating energy can be reduced. Moreover, it is also possible to apply the treatment liquid by an application device such as a roller. In this case, it is possible to deposit the treatment liquid in a thin layer, and the drying duration can be shortened and the required heating energy can be reduced.

The treatment liquid drying unit 16 is disposed to the downstream side of the treatment liquid deposition unit 14 in terms of the sub-scanning direction, whereby the treatment liquid that has been deposited on the coating layer of the recording medium 12 is dried. The drying conditions are controlled so as to achieve a prescribed distribution of aggregating agent in the layers of the recording medium 12, when the deposition of ink droplets is performed on the downstream side. More specifically, the treatment liquid is dried in such a manner that, when the droplets of the ink are deposited, the effective pH of the aggregating agent is not lower than 1.67 and not higher 7.0 (in terms of the amount of aggregating agent, 0 g/m$^2$ or more and 0.1 g/m$^2$ or less) on the surface of the coating layer of the recording medium 12, and the effective pH of the aggregating agent is not lower than 0.1 and not higher than 1.7 (in terms of the amount of aggregating agent, 0.1 g/m$^2$ or more and 2.0 g/m$^2$ or less) in the coating layer of the recording medium 12.

The ink droplet ejection unit 18 is provided with inkjet type recording heads (hereinafter referred to as "ink ejection heads") 18C, 18M, 18Y and 18K, which correspond to the respective colored inks of cyan (C), magenta (M), yellow (Y) and black (K), and eject droplets of the corresponding colored inks from the nozzles of the ink ejection heads 18C, 18M, 18Y and 18K in accordance with the input image data. In the present embodiment, the ejection volume (droplet ejection volume) of the ink droplets ejected from the nozzles is 2 ng, and the recording density (droplet deposition density) is 1200 dpi in both the main scanning direction (the direction perpendicular to the conveyance direction of the recording medium 12) and the sub-scanning direction (the conveyance direction of the recording medium 12). Furthermore, in the present embodiment, droplets of the ink are ejected and deposited when the surface and the inside of the coating layer of the recording medium 12 have assumed a prescribed state, as described below.

The ink drying unit 20 is disposed to the downstream side of the ink droplet ejection unit 18 in terms of the sub-scanning direction, and dries the ink droplets that have been deposited on the recording medium 12. There are no particular restrictions on the ink drying method, but similarly to the treatment liquid drying unit 16, it is desirable to adopt the method which blows hot air onto the ink on the recording medium 12 (hot air drying method). Furthermore, it is also desirable to adopt, either in conjunction with the hot air drying method described above, or independently, the rear surface heating method in which a heater (for example, a flat plate heater) 32 is provided on the rear surface side of the recording medium 12 (the side opposite to the image forming surface) and the recording medium 12 is thereby heated from the rear surface side. In the present embodiment, in order to dry the ink layer on the recording medium 12, the rear surface side of the recording medium 12 is heated to 60° C. by the heater 32 while the hot air of 70° C. is blown onto the front surface side of the recording medium 12 for 2 seconds from the hot air drying device (blower).

The fixing unit 22 is provided with heating rollers 33 and 34, and presses the heating roller (fixing roller) 33 onto the ink layer formed on the recording medium 12 to heat and press the ink so as to fuse the self-dispersing polymer particles in the ink, and thereby fixing the image formed on the recording medium 12. It is thereby possible to improve wear resistance of the image, so that good image quality can be achieved. Desirably, the heating temperature of the heating rollers 33 and 34 is set in accordance with the glass transition temperature of the polymer particles contained in the treatment liquid or the ink. Furthermore, it is also possible to provide heating rollers 33 and 34 in a plurality of stages in such a manner that the image formed on the recording medium 12 can be fixed in a stepwise fashion.

Next, the characteristic portions of the embodiment of the present invention will be described. The ink droplet ejection unit 18 of the present embodiment ejects and deposits droplets of the ink when the surface and the inside of the coating layer of the recording medium 12 have assumed a prescribed state, as described below. More specifically, control is implemented in such a manner that ink droplets are ejected and deposited in a state where the effective pH of the aggregating agent on the surface of the coating layer of the recording medium 12 is not lower than 1.67 and not higher than 7.0, and also the effective pH of the aggregating agent inside the coating layer of the recording medium 12 is not lower than 0.1 and not higher than 1.7. In other words, if the effective pH of the aggregating agent is represented in terms of the amount of the aggregating agent, the control is implemented in such a manner that ink droplets are ejected and deposited in a state where the amount of the aggregating agent on the surface of the coating layer of the recording medium 12 is 0 $g/m^2$ or more and 0.1 $g/m^2$ or less, and also the amount of the aggregating agent inside the coating layer of the recording medium 12 is 0.1 $g/m^2$ or more and 2.0 $g/m^2$ or less.

Furthermore, in a more desirable mode, control is implemented in such a manner that ink droplets are ejected and deposited in a state where the effective pH of the aggregating agent in the base paper layer of the recording medium 12 is not lower than 1.4 and not higher than 7.0. In other words, if the effective pH of the aggregating agent is represented in terms of the amount of the aggregating agent, the control is implemented in such a manner that ink droplets are ejected and deposited in a state where the amount of the aggregating agent in the base paper layer of the recording medium 12 is 0 $g/m^2$ or more and 0.21 $g/m^2$ or less.

The method selected as a control method is one of controlling the drying conditions in the treatment liquid drying unit 16, controlling the timing of the ejection of the ink droplets by the ink droplet ejection unit 18, and the like. The drying conditions and the droplet ejection timing whereby the effective pH or the amount of the aggregating agent come within the above-described ranges can be determined in advance by prior experimentation, or the like. In this experimentation, it is possible to use a liquid chromatography method to measure the aggregating agent, and the amount (or the effective pH) of the respective aggregating agents can be determined as described below. For example, the amount of the aggregating agent on the surface of the coating layer of the recording medium 12 is found by measuring the total amount X of the aggregating agent deposited on the coating layer of the recording medium 12, wiping the aggregating agent from the surface of the coating layer of the recording medium 12 with a non-woven cloth impregnated with water, and measuring the remaining amount Z of the aggregating agent contained in the recording medium 12. The amount of the aggregating agent on the surface of the coating layer of the recording medium 12 can be determined by calculating (X−Z). The amount of the aggregating agent inside the coating layer of the recording medium 12 is found by cutting away the coating layer of the recording medium 12 with a single-edged razor, measuring the amount Y of the aggregating agent contained in the remaining base paper layer, and then calculating (Z−Y). The amount of the aggregating agent contained in the base paper layer of the recording medium 12 is Y.

The effective pH of the aggregating agent that acts on the aggregation of the ink in each layer is found by dissolving the amount of the aggregating agent present in each layer, in an aqueous solvent corresponding to the amount of primary color ink, and finding the pH of that solution.

Figure 2A:
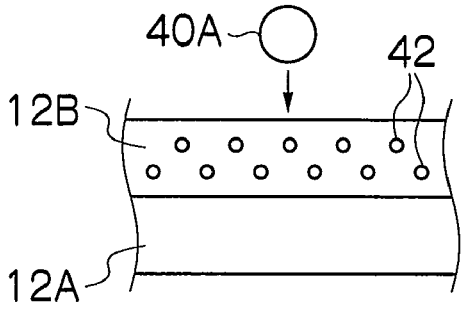
FIGS. 2A and 2B are schematic drawings showing a recording medium when depositing ink droplets according to the present embodiment.
Figure 2B:
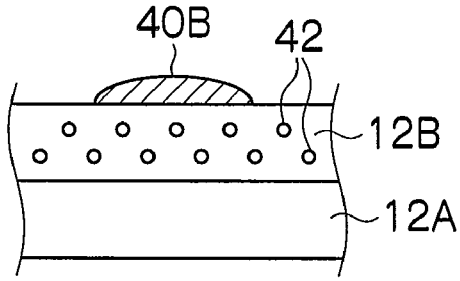
Figure 3A:
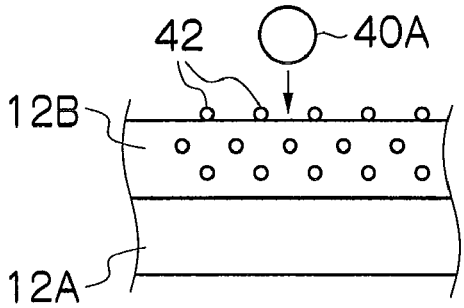
FIGS. 3A and 3B are schematic drawings showing a recording medium when depositing ink droplets according to a comparative example.
Figure 3B:
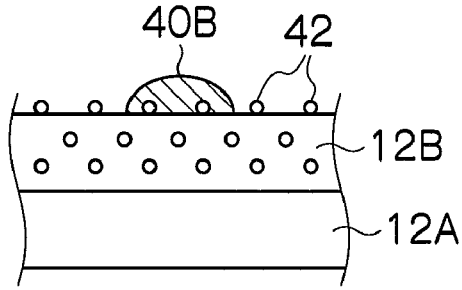
Figure 4A:
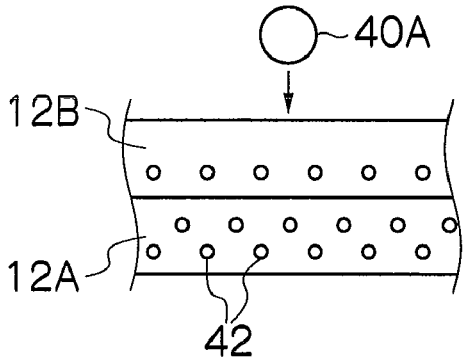
FIGS. 4A and 4B are schematic drawings showing a recording medium when depositing ink droplets according to another comparative example.
Figure 4B:
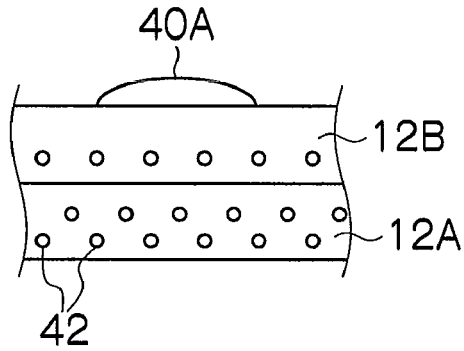

The operation of the above-described image forming apparatus 10 is explained with reference to FIGS. 2A to 4B. Each of FIGS. 2A, 3A and 4A shows a schematic view of the state of the recording medium 12 when depositing a droplet of the ink, and each of FIGS. 2B, 3B and 4B shows a schematic view of the state of the recording medium 12 when ejecting another droplet of the ink from an adjacent nozzle, after the deposition of the previous droplet of the ink. In FIGS. 2A to 4B, reference numeral 12A denotes a base paper layer of the recording medium 12, reference numeral 12B denotes a coating layer of the recording medium 12, reference numeral 40A denotes a droplet (liquid) of the ink, reference numeral 40B denotes an aggregate of the ink, and small circles denoted with reference numeral 42 represent the aggregating agent and also show the level of permeation of the aggregating agent.

FIG. 3A shows a state where the aggregating agent 42 has not permeated sufficiently into the recording medium 12, and more specifically, a state where the effective pH of the aggregating agent 42 on the surface of the coating layer 12B of the recording medium 12 is lower than 1.7 (in terms of the amount of the aggregating agent, more than 0.1 $g/m^2$), and the effective pH of the aggregating agent 42 inside the coating layer 12B is lower than 0.1 (in terms of the amount of the aggregating agent, more than 2.0 $g/m^2$).

In this case, an excess amount of the aggregating agent 42 is present on the surface of the coating layer 12B of the recording medium 12. Consequently, if an ink droplet 40A is deposited in this state, then it reacts with the large amount of the aggregating agent 42 on the surface of the coating layer 12B, and therefore the aggregating reaction proceeds before the ink dot spreads sufficiently, as shown in FIG. 3B, thereby reducing the dot diameter of the ink aggregate 40B. This is thought to be because while the spreading of the ink dot occurs as a result of the force of impact upon landing of the ink droplet due to the kinetic energy of the flying ink droplet, and this spreading happens in a time of several microseconds (μsec) to several tens of microseconds, whereas the aggregating reaction on the surface of the coating layer 12B occurs in an extremely short time in the order of few microseconds or sub-microseconds due to the dissolution of the aggregating agent 42 and the ink droplet 40A, and therefore the ink aggregate 40B is formed before the ink droplet 40A spreads.

Moreover, if the ink droplet 40A is deposited in a state where there is excess aggregating agent 42 on the surface of the coating layer 12B of the recording medium 12, then the aggregating agent 42 precipitates on the surface of the coating layer 12B, so that a change occurs in the glossiness of the paper and the image quality declines. Furthermore, if the ink droplet 40A is deposited in a state where there is excess aggregating agent 42 on the surface of the coating layer 12B of the recording medium 12, then a separating layer is formed by the aggregating agent 42 at the interface between the image film and the coating layer 12B, and the adhesiveness of the image film with respect to the recording medium 12 declines.

FIG. 4A shows a state where the aggregating agent 42 has permeated excessively into the recording medium 12, and more specifically, a state where the effective pH of the aggregating agent 42 on the surface of the coating layer 12B of the recording medium 12 is higher than 7.0, and the effective pH of the aggregating agent 42 inside the coating layer 12B is higher than 1.7 (in terms of the amount of the aggregating agent, less than 0.1 g/m$^2$).

In this case, a large amount of the aggregating agent 42 is present in the base paper layer 12A of the recording medium 12, and the aggregating agent 42 on the surface of the coating layer 12B of the recording medium 12 and inside the coating layer 12B is insufficient. If an ink droplet 40A is deposited in this state, then due to the permeation of the solvent of the ink droplet 40A into the base paper layer 12A of the recording medium 12, the aggregating agent 42 moves and diffuses, and an aggregating reaction is then achieved. However, since the solvent in the ink droplet 40A that has reached the base paper layer 12A swiftly wets and spreads inside the base paper layer 12A, then the supply efficiency of the aggregating agent 42 becomes low and the aggregating reaction occurs in the order of several tens to several hundreds of milliseconds (msec). On the other hand, another droplet of the ink is ejected and deposited from the adjacent nozzle after approximately 4 msec (although this time varies with the nozzle arrangement and the conveyance speed of the recording medium 12 during printing) of the ink droplet 40A. Consequently, when another droplet of the ink is ejected and deposited from the adjacent nozzle, a sufficient aggregating reaction has not yet occurred in the ink droplet 40A as shown in FIG. 4B and therefore landing interference occurs.

On the other hand, FIG. 2A shows a state in the deposition of a droplet of the ink according to the embodiment of the present invention, and depicts a state where the effective pH of the aggregating agent 42 on the surface of the coating layer 12B of the recording medium 12 is not lower than 1.67 and not higher than 7.0 (in terms of the amount of the aggregating agent, 0 g/m$^2$ or more and 0.1 g/m$^2$ or less) and the effective pH of the aggregating agent 42 inside the coating layer 12B is not lower than 0.1 and not higher than 1.7 (in terms of the amount of the aggregating agent, 0.1 g/m$^2$ or more and 2.0 g/m$^2$ or less).

In this case, the solvent of the ink droplet 40A permeates chiefly into the coating layer 12B of the recording medium 12, and the aggregating agent (i.e., protons) 42 is present in plenty inside the coating layer 12B. Therefore, if the ink droplet 40A is deposited in this state, the aggregating agent 42 inside the coating layer 12B moves and diffuses, and an aggregating reaction occurs as shown in FIG. 2B in a time of the order of milliseconds. Consequently, since the spreading of the ink dot occurs more quickly than the aggregating reaction, then the aggregating reaction proceeds gradually while the dot is spreading, the spreading of the dot can be guaranteed, and reduction in the diameter of the dot can be prevented. Furthermore, since the aggregating reaction is completed before another droplet of the ink is ejected and deposited from the adjacent nozzle, then it is possible to suppress landing interference, and high-definition can be achieved satisfactorily in the image.

In this way, according to the present embodiment, since the ink droplet 40A is deposited when the effective pH of the aggregating agent 42 on the surface of the coating layer 12B of the recording medium 12 is 1.67 or higher and 7.0 or lower, and when the effective pH of the aggregating agent 42 inside the coating layer 12B is 0.1 or higher and 1.7 or lower, then it is possible to ensure spreading of the dots, as well as being able to improve the definition of the image.

Moreover, in the present embodiment, the ink droplet 40A is deposited in a state where the effective pH of the aggregating agent 42 in the base paper layer 12A of the recording medium 12 is 1.4 or higher and 7.0 or lower (in terms of the amount of the aggregating agent, 0 g/m$^2$ or more and 0.21 g/m$^2$ or less). If the effective pH of the aggregating agent 42 in the base paper layer 12A is lower than 1.4, then yellowing occurs with temporal change (this is assumed to be discoloration of lignin in the base paper layer). It is possible to prevent occurrence of yellowing in the present embodiment.

Evaluation Experiments

Next, the evaluation experiments relating to the present invention will be described.

The treatment liquid and the ink used in the evaluation experiments have the respective compositions described below.

| <Treatment liquid> | |
|---|---|
| Malonic acid | 10 parts by weight |
| Diethylene glycol monoethyl ether | 20 parts by weight |
| Surfactant 1 | 1 part by weight |
| Deionized water | remainder |

The surfactant 1 described above is represented as:

$$CF_3CF_2—(CF_2CF_2)_m—CH_2CH_2—(OCH_2CH_2)_n—OH.$$

| <Ink> | |
|---|---|
| Pigment 1 | 4 parts by weight |
| Dispersant polymer 1 | 2 parts by weight |
| Resin emulsion | 8 parts by weight |
| Glycerin | 15 parts by weight |
| Surfactant 2 | 1 part by weight |
| Deionized water | remainder |

The details of the respective components described above were as follows.

Pigment 1: Cromophtal Jet Magenta DMQ (PR-122) (Ciba Specialty Chemicals Inc.)

Dispersant polymer 1: benzyl methacrylate/methyl methacrylate/methacrylic acid, 60/30/10 (weight ratio)

Resin emulsion 1: methyl methacrylate/phenoxyethyl acrylate/acrylic acid, 60/35/5 (weight ratio), MFT=35° C.

Resin emulsion 2: methyl methacrylate/phenoxyethyl acrylate/acrylic acid, 66/29/5 (weight ratio), MFT=50° C.

Surfactant 2: Olefin E1010 (made by Nisshin Chemical Industry Co., Ltd.)

<Experimental Conditions>

The relationship between the distribution of the aggregating agent and respective properties was investigated by controlling, as experimental parameters, the type of aggregating agent, the concentration of the aggregating agent, the treatment liquid application volume, and the time from deposition of the treatment liquid until drying.

Paper: Tokubishi Art (made by Mitsubishi Paper Mills), basis weight: 104.7 g/m$^2$ Treatment liquid deposition volume: Prescribed volume deposited by inkjet head Time from deposition until drying of treatment liquid: 1 second to 5 seconds (by controlling conveyance speed of paper)

Drying of treatment liquid: Dried for one second by a rear surface heater at 40° C. and heated air flow at 70° C.

Ink deposition: Droplets ejected to form dots and full surface solid pattern on paper, at ejection volume of 2 pl Ink drying: Dried for 2 seconds by a rear surface heater at 60° C. and heated air flow at 70° C.

Ink fixing: Heat fixing by nipping recording medium between front surface roller and rear surface roller; Front surface roller (40 mm-diameter metal roller with 1 mm silicone rubber coating); Rear surface roller (metal roller); Front surface roller 80° C./Rear surface roller 60° C./Nip pressure 1.2 MPa/Nip time 20 ms <Measurement of Aggregating Agent Distribution>

Gas chromatography was used to measure the amount of aggregating agent in the paper. A Shimadzu Corp. Gas Chromatograph GC-2014 was used as the chromatograph and a Shimadzu Corp. Flame Ionization Detector FID-2014 was used as the extractor.

The following method was used to measure the distribution of the aggregating agent.

1. The total amount X of the aggregating agent deposited onto the paper is measured.

2. The coating layer of the paper is cut away using a single-edged razor (made by Feather Safety Razor) and the amount Y of the aggregating agent contained in the remaining base paper layer is measured.

3. The aggregating agent on the surface of the coating layer of the paper is wiped away using a nonwoven cloth impregnated with water, and the amount Z of the aggregating agent contained in the remaining paper is measured.

4. The amount of the aggregating agent on the surface of the coating layer of the recording medium is calculated by (X−Z), the amount of the aggregating agent inside the coating layer is calculated by (Z−Y), and the amount of the aggregating agent in the base paper layer is taken as Y.

<Method of Measuring Effective pH>

Figure 5:
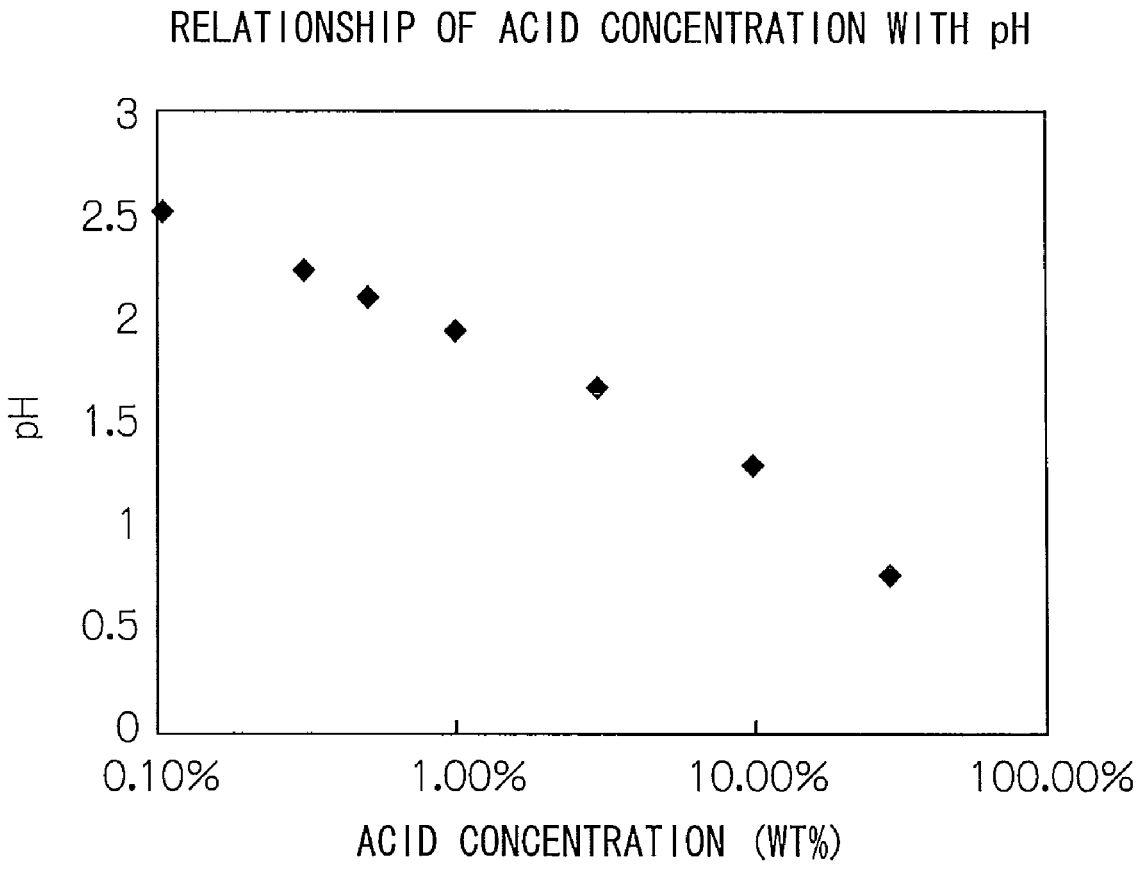
FIG. 5 is a diagram of the relationship between the concentration of the aggregating agent in the aqueous solution and the pH of the aqueous solution.

The effective pH of the aggregating agent that acts on the aggregation of ink in each layer is defined as the pH of the liquid obtained by dissolving the amount of the aggregating agent present in each layer in an aqueous solvent equivalent to the amount of primary color ink. In the present embodiment, recording is performed by means of ink droplets of 2 ng at 1200 dpi per color, and therefore the solvent equivalent to the amount of primary color ink is calculated to be 4.5 g/m$^2$. The pH was measured using an electrical conductivity pH meter WM-50 EG (made by DKK-Toa). The relationship between the concentration of the aggregating agent in the aqueous solution and the pH of the aqueous solution used in the present embodiment was as shown in FIG. 5.

<Method of Evaluating Quality>

<<Dot Diameter>>

The dot diameter was measured using an optical microscope and here an Oji Scientific Instruments dot analyzer was used. From the viewpoint of forming a solid image without any blank areas, it is not desirable for the dot diameter to be too small, and therefore a certain amount of spreading is required in the dot diameter. If the dot diameter is small, it is necessary to increase the ink droplet ejection volume in order to form a solid image, and this has significant adverse effects on paper curling and drying, fixing properties, and other characteristics. Furthermore, if the dot diameter is larger than necessary, then this is not desirable since the definition of the image is impaired. From the viewpoint described above, printing at 1200 dpi (dot pitch of 21.2 μm) is assumed and the following judgment criteria were applied to the dot diameter.

Good: larger than 29 μm and smaller than 38 μm (desirable dot diameter)

Fair: larger than 27 μm and not larger than 29 μm (some insufficiency in dot diameter, but within tolerances)

Poor: not larger than 27 μm (dot diameter insufficient) or not smaller than 38 μm (dot diameter too large)

<<Change in Glossiness of Paper>>

The glossiness of the front surface of the paper at 60° after depositing the treatment liquid was measured, and the change in the glossiness with respect to the value obtained for the paper alone was evaluated. A Horiba IG-320 gloss meter was used to measure the gloss. The level of glossiness of the paper used for evaluation was 45.

Good: Change in glossiness of less than 5; no substantial change in glossiness observed Fair: Change in glossiness of not less than 5 and less than 10; slight change in glossiness observed, but of acceptable level Poor: Change in glossiness of not less than 10; large change in glossiness, undesirable <<Image Resolution>>

If the aggregating reaction is insufficient, then interference between the dots occurs and the image resolution declines. An image composed of a solid pattern excluding a portion of the dots was recorded and was evaluated visually as stated below, as an indicator of image resolution.

Good: one-dot white spots can be reproduced

Fair: 2 dots×2 dots white spots can be reproduced, but one-dot white spots cannot be reproduced Poor: 2 dots×2 dots white spots cannot be reproduced <<Drying Time>>

The drying time is defined as the minimum drying time whereby blocking does not occur in stacked sheets after printing. Blocking was evaluated as described below using A4 sheets of paper in environment of 23° C. and 50% RH. A solid image was printed on a sheet of paper with ink at 10.0 g/m$^2$, a plain sheet of paper was placed on the image directly after printing, the two sheets of paper were placed between two sheets of acrylic and pressed with a weight of 10 kg. The sheets of paper were left for one hour, the acrylic sheets were then removed, the superimposed sample was peeled away by hand, and the level of adherence was verified. If the paper was able to be peeled away without the transfer of the ink or adherence of the paper, then it was considered that no blocking had occurred. If ink transfer occurred or the paper was not able to be peeled away, then it was considered that blocking had occurred.

<<Adhesiveness>>

A cellophane tape (made by Nichiban) cut to approximately 30 mm was attached, without trapping air, to a solid image which had been conditioned for one day in a standard environment of 23° C. and 50% RH after printing, and the cellophane tape was peeled away slowly in a vertical upward direction over a period of approximately 3 seconds. Change in the shape of the peeled surface and transfer of color to the cellophane tape were observed visually, and the following verdicts were applied.

Good: No detachment, or detachment within layer of paper

Fair: Color transferred to tape, but no change in ink surface

Poor: Change in ink surface or detachment between ink layer and paper

<<Yellowing of Paper>>

Paper on which the treatment liquid had been deposited was conditioned for ten days in an environment of 60° C. and 60% RH, the optical density was measured with Status A, and the difference in the yellow density (ΔY) was measured. An Xrite 938 device was used to measure the optical density.

Good: ΔY of not greater than 3

Fair: ΔY of greater than 3 and less than 5

Poor: ΔY of not less than 5

<Evaluation>

FIG. 6 is a table showing the results of the experiment described above, and FIG. 7 shows the relationship between the amount of the aggregating agent on the surface of the coating layer of the recording medium 12 and the dot diameter.

Figure 7:
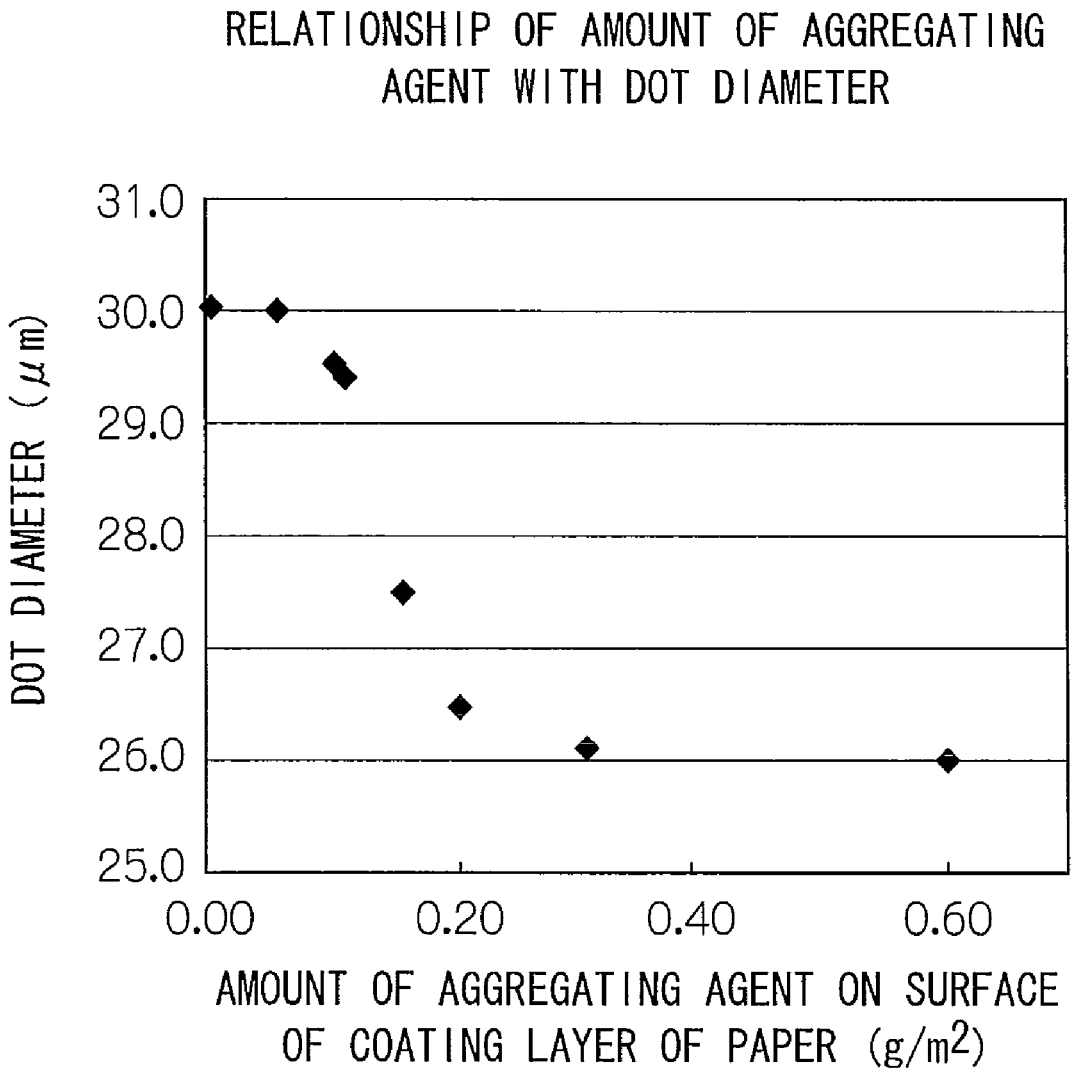
FIG. 7 is a diagram showing the relationship between the amount of the aggregating agent on the surface of the coating layer of the recording medium and the dot diameter.

As shown in FIGS. 6 and 7, when the amount of the aggregating agent on the surface of the coating layer of the recording medium 12 increased and exceeded a threshold value, then this resulted in a sudden reduction in the dot diameter, decline in glossiness became liable to occur, and the adhesiveness declined. It was found that this threshold value was 0.1 $g/m^2$ or less, and the effective pH of the aggregating agent in this case was 1.67 or higher and 7.0 or lower.

As can be seen from FIG. 6, if the effective pH of the aggregating agent inside the coating layer of the recording medium 12 deviated from the range of 0.1 or higher and 1.7 or lower (in terms of the amount of the aggregating agent, 0.1 $g/m^2$ or more and 2.0 $g/m^2$ or less), then this resulted in the occurrence of landing interference, and a long drying time needed to be taken.

If the effective pH of the aggregating agent in the base paper layer of the recording medium 12 deviated from the range of 1.4 or higher and 7.0 or lower (in terms of the amount of the aggregating agent, 0 $g/m^2$ or more and 0.21 $g/m^2$ or less), then this resulted in yellowing of the recording medium.

Image Forming Apparatus According to Another Embodiment

Figure 8:
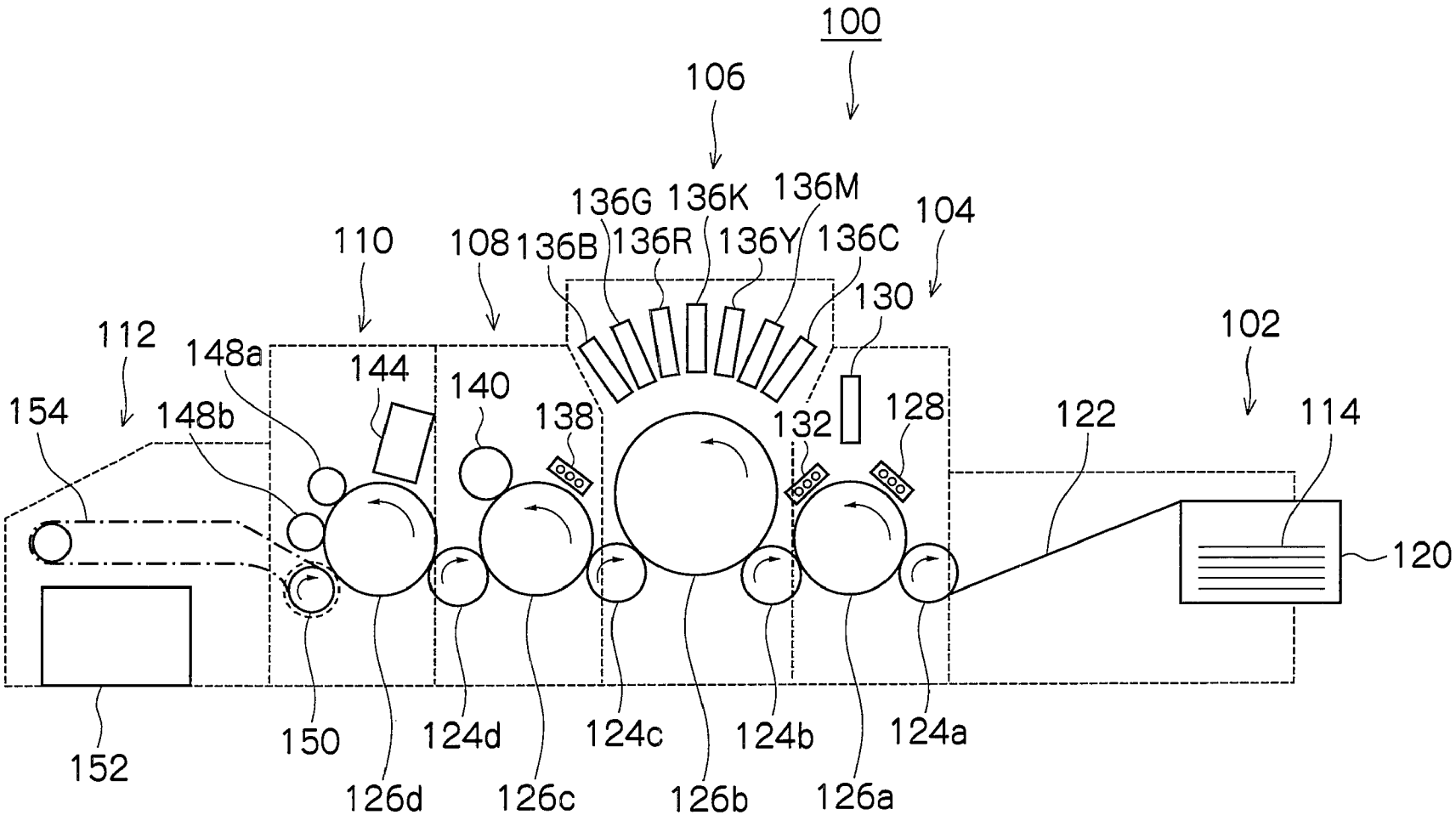
FIG. 8 is a general schematic drawing showing an inkjet recording apparatus according to an embodiment of the present invention.

FIG. 8 is a general schematic drawing showing an image forming apparatus according to another embodiment of the present invention, in which the drum system is employed.

The image forming apparatus (inkjet recording apparatus) 100 shown in FIG. 8 is a decoding apparatus that employs a two-liquid reaction system using ink and treatment liquid (aggregating treatment liquid) to form an image on a recording medium 114. The inkjet recording apparatus 100 includes: a paper supply unit 102, which supplies the recording medium 114; a treatment liquid deposition unit 104, which deposits the treatment liquid on the recording medium 114; an ink deposition unit (print unit) 106, which forms an image by depositing droplets of colored ink onto the recording medium 114; a solvent removing unit 108, which removes the solvent component (liquid component) on the recording medium 114; a fixing unit 110, which fixes the image formed on the recording medium 114; and a paper output unit 112, which conveys and outputs the recording medium 114 on which the image has been formed.

The paper supply unit 102 is provided with a paper supply platform 120, on which the recording media 114 are stacked. A feeder board 122 is connected to the front (the left-hand side in FIG. 8) of the paper supply platform 120, and the recording media 114 stacked on the paper supply platform 120 are supplied one sheet at a time, successively from the uppermost sheet, to the feeder board 122. The recording medium 114 that has been conveyed to the feeder board 122 is transferred through a transfer drum 124*a* to a pressure drum (treatment liquid drum) 126*a* of the treatment liquid deposition unit 104.

Although not shown in the drawings, holding hooks (grippers) and a suction port for holding the leading edge of the recording medium 114 are formed on the surface (circumferential surface) of the pressure drum 126*a*, and the recording medium 114 that has been transferred to the pressure drum 126*a* from the transfer drum 124*a* is conveyed in the direction of rotation (the counter-clockwise direction in FIG. 8) of the pressure drum 126*a* in a state where the leading edge is held by the holding hooks and the medium adheres tightly to the surface of the pressure drum 126*a* (in other words, in a state where the medium is wrapped about the pressure drum 126*a*). A similar composition is also employed for the other pressure drums 126*b* to 126*d*, which are described hereinafter.

The treatment liquid deposition unit 104 is provided with a paper preheating unit 128, a treatment liquid ejection head 130 and a treatment liquid drying unit 132 at positions opposing the surface of the pressure drum 126*a*, in this order from the upstream side in terms of the direction of rotation of the pressure drum 126*a* (the counter-clockwise direction in FIG. 8).

The paper preheating unit 128 is provided with a hot air drying device blowing hot air of which the temperature and flow rate can be controlled within a prescribed range, thereby achieving a composition where the hot air heated by the hot air drying device is blown onto the recording medium 114 when the recording medium 114 that is held on the pressure drum 126*a* passes the position opposing the hot air drying device of the paper preheating unit 128.

The treatment liquid ejection head 130 ejects and deposits droplets of the treatment liquid onto the recording medium 114 that is held on the pressure drum 126*a*. The treatment liquid ejection head 130 adopts the same composition as ink ejection heads 136C, 136M, 136Y, 136K, 136R, 136G and 136B of the ink deposition unit 106, which is described below.

In the present embodiment, the inkjet head is used to deposit the treatment liquid onto the surface of the recording medium 114; however, the present invention is not limited to this, and it is possible to employ a spraying method, an application method, or other methods of various types.

The treatment liquid used in the present embodiment is an acidic liquid that has the action of aggregating the coloring materials contained in the inks that are ejected onto the recording medium 114 respectively from the ink ejection heads 136C, 136M, 136Y, 136K, 136R, 136G and 136B disposed in the ink deposition unit 106, which is arranged at a downstream stage.

The treatment liquid drying unit 132 is provided with a hot air drying device blowing hot air of which the temperature and flow rate can be controlled within a prescribed range, thereby achieving a composition where the hot air heated by the hot air drying device is blown onto the treatment liquid on the recording medium 114 when the recording medium 114 that is held on the pressure drum 126*a* passes the position opposing the hot air drying device of the treatment liquid drying unit 132. In the present embodiment, the treatment liquid is dried by means of the hot air of 80° C.

The temperature and flow rate of the hot air drying device are set to values whereby the treatment liquid having been deposited on the recording medium 114 by the treatment liquid ejection head 130 disposed to the upstream side in terms of the direction of rotation of the pressure drum 126*a* is dried so that the solid or semi-solid aggregating treatment agent layer (the thin film layer of dried treatment liquid) is formed on the surface of the recording medium 114.

It is desirable that the recording medium 114 is preheated by the paper preheating unit 128, before depositing the treatment liquid on the recording medium 114, as in the present embodiment. In this case, it is possible to restrict the heating energy required to dry the treatment liquid to a low level, and therefore energy savings can be made.

The ink deposition unit 106 is arranged after the treatment liquid deposition unit 104. A transfer drum 124*b* is arranged between the pressure drum (treatment liquid drum) 126*a* of the treatment liquid deposition unit 104 and a pressure drum (print drum) 126*b* of the ink deposition unit 106, so as to make contact with same. Hence, after the treatment liquid is deposited and the treatment liquid layer (desirably, the solid or semi-solid aggregating treatment agent layer) is formed on the recording medium 114 that is held on the pressure drum 126*a* of the treatment liquid deposition unit 104, the recording medium 114 is transferred through the transfer drum 124*b* to the pressure drum 126*b* of the ink deposition unit 106.

The ink deposition unit 106 is provided with ink ejection heads 136C, 136M, 136Y, 136K, 136R, 136G and 136B, which correspond respectively to the seven colors of ink, C, M, Y, K, R, G and B at positions opposing the surface of the pressure drum 126*b*, in this order from the upstream side in terms of the direction of rotation of the pressure drum 126*b* (the counter-clockwise direction in FIG. 8).

The ink ejection heads 136C, 136M, 136Y, 136K, 136R, 136G and 136B employ the inkjet type recording heads (inkjet heads), similarly to the above-described treatment liquid ejection head 130. The ink ejection heads 136C, 136M, 136Y, 136K, 136R, 136G and 136B respectively eject droplets of corresponding colored inks onto the recording medium 114 held on the pressure drum 126*b*.

An ink storing and loading unit (not shown) is configured by ink tanks that store colored inks supplied to the ink ejection heads 136C, 136M, 136Y, 136K, 136R, 136G and 136B. Each ink tank communicates with a corresponding head through a required channel, and supplies the corresponding ink to the head. The ink storing and loading unit also includes a notification device (display device, alarm sound generator) such that when the residual amount of ink is small, the user is notified to this effect. In addition, the ink storing and loading unit includes a mechanism preventing the erroneous loading of colored inks.

The colored inks are supplied to the ink ejection heads 136C, 136M, 136Y, 136K, 136R, 136G and 136B from the tanks of the ink storing and loading unit, and droplets of the colored inks are ejected and deposited to the recording medium 114 by the ink ejection heads 136C, 136M, 136Y, 136K, 136R, 136G and 136B in accordance with the image signal.

Each of the ink ejection heads 136C, 136M, 136Y, 136K, 136R, 136G and 136B is a full-line head having a length corresponding to the maximum width of the image forming region of the recording medium 114 held on the pressure drum 126*b*, and having a plurality of nozzles 161 (not shown in FIG. 8 and shown in FIGS. 9A to 9C) for ejecting the ink, which are arranged on the ink ejection surface of the head through the full width of the image forming region. The ink ejection heads 136C, 136M, 136Y and 136K are arranged so as to extend in a direction that is perpendicular to the direction of rotation of the pressure drum 126*b* (the conveyance direction of the recording medium 114).

According to the composition in which the full line heads having the nozzle rows covering the full width of the image forming region of the recording medium 114 are provided respectively for the colors of ink, it is possible to record a primary image on the image forming region of the recording medium 114 by performing just one operation of moving the recording medium 114 and the ink ejection heads 136C, 136M, 136Y, 136K, 136R, 136G and 136B relatively with respect to each other (in other words, by one sub-scanning action). Therefore, it is possible to achieve a higher printing speed compared to a case that uses a serial (shuttle) type of head moving back and forth reciprocally in the main scanning direction, which is the direction perpendicular to the sub-scanning direction or the conveyance direction of the recording medium 114, and hence it is possible to improve the print productivity.

The inkjet recording apparatus 100 according to the present embodiment is able to record on recording media (recording paper) up to a maximum size of 720 mm×520 mm and hence a drum having a diameter of 810 mm corresponding to the recording medium width of 720 mm is used for the pressure drum (print drum) 126*b*. The drum rotation peripheral speed when depositing the ink droplets is 530 mm/sec. The ink ejection volume of the ink ejection heads 136C, 136M, 136Y, 136K, 136R, 136G and 136B is 2 pl, and the recording density is 1200 dpi in both the main scanning direction (the breadthways direction of the recording medium 114) and the sub-scanning direction (the conveyance direction of the recording medium 114).

Although the configuration with the seven colors of C, M, Y, K, R, G and B is described in the present embodiment, the combinations of the ink colors and the number of colors are not limited to those. Light and/or dark inks, and special color inks can be added as required. For example, a configuration is possible in which ink ejection heads for ejecting light-colored inks, such as light cyan and light magenta, are added. Furthermore, there is no particular restriction on the arrangement sequence of the heads of the respective colors.

The solvent removing unit 108 is arranged after the ink deposition unit 106. A transfer drum 124*c* is arranged between the pressure drum (print drum) 126*b* of the ink deposition unit 106 and a pressure drum (solvent removing drum) 126*c* of the solvent removing unit 108, so as to make contact with same. Hence, after the colored inks are deposited on the recording medium 114 that is held on the pressure drum 126*b* of the ink deposition unit 106, the recording medium 114 is transferred through the transfer drum 124*c* to the pressure drum 126*c* of the solvent removing unit 108.

The solvent removing unit 108 is provided with an ink drying unit 138 and a solvent removing roller 140 at positions opposing the surface of the pressure drum 126*c*, in this order from the upstream side in terms of the direction of rotation of the pressure drum 126*c* (the counter-clockwise direction in FIG. 8).

The ink drying unit 138 has a composition provided with a hot air drying device blowing hot air of which the temperature and flow rate can be controlled within a prescribed range, similarly to the paper preheating unit 128 and the treatment liquid drying unit 138, which have been described above. The hot air drying device of the ink drying unit 138 blows the hot air of the prescribed temperature (e.g., 70° C.) onto the recording medium 114 so that the solvent components (mainly water) of the ink layer on the recording medium are evaporated off. It is thereby possible to suppress the amount of water to permeate the recording medium 114, so that the recording medium 114 can be prevented from curling.

The solvent removing roller 140 has the same composition with the solvent removing roller in the fixing unit 22 shown in FIG. 1. More specifically, the solvent removing roller 140 is a roller-shaped member having a surface made of a porous material, and by bringing the solvent removing roller 140 into contact with the ink layer on the recording medium 114, the residual solvent (mainly high-boiling-point solvent) remaining on the recording medium 114 is removed. Thereby, stickiness of the ink layer (i.e., the ink image) due to the high-boiling-point solvent is suppressed and the blocking of the recording medium 114 can be prevented. Furthermore, by evaporating off the solvent component (mainly water) in the ink layer on the recording medium 114 before removing the residual solvent (mainly high-boiling-point solvent) by means of the solvent removing roller 140, the aggregating force of the ink aggregate (coloring material aggregate) formed by the reaction with the treatment liquid can be improved and the adherence of the coloring material to the solvent removing roller 140 can be prevented.

The fixing unit 110 is arranged after the solvent removing unit 108. A transfer drum 124*d* is arranged between the pressure drum (solvent removing drum) 126*c* of the solvent removing unit 108 and a pressure drum (fixing drum) 126*d* of the fixing unit 110, so as to make contact with same. Hence, after the solvent component is removed from the recording medium 114 that is held on the pressure drum 126*c* of the solvent removing unit 108, the recording medium 114 is transferred through the transfer drum 124*d* to the pressure drum 126*d* of the fixing unit 110.

The fixing unit 110 is provided with a print determination unit 144, which reads in the print results of the ink deposition unit 106, and heating rollers 148*a* and 148*b* at positions opposing the surface of the pressure drum 126*d*, in this order from the upstream side in terms of the direction of rotation of the pressure drum 126*d* (the counter-clockwise direction in FIG. 8).

The print determination unit 144 includes an image sensor (a line sensor, or the like), which captures an image of the print result of the ink deposition unit 106 (the droplet ejection results of the ink ejection heads 136C, 136M, 136Y, 136K, 136R, 136G and 136B), and functions as a device for checking for nozzle blockages and other ejection defects, on the basis of the droplet ejection image captured through the image sensor.

The heating rollers 148*a* and 148*b* are rollers of which temperature can be controlled in a prescribed range (e.g., 100° C. to 180° C.), and fix the image formed on the recording medium 114 while nipping the recording medium 114 between the pressure drum 126*d* and each of the heating rollers 148*a* and 148*b* to heat and press the recording medium 114.

In the present embodiment, the heating temperature of the heating rollers 148*a* and 148*b* is set to 110° C., and the surface temperature of the pressure drum 126*d* is set to 60° C. Furthermore, the nip pressure of the heating rollers 148*a* and 148*b* is 1 MPa. It is desirable that the heating temperature of the heating rollers 148*a* and 148*b* is set in accordance with the glass transition temperature of the polymer particles contained in the treatment liquid or the ink.

The paper output unit 112 is arranged after the fixing unit 110. The paper output unit 112 is provided with a paper output drum 150, which receives the recording medium 114 on which the image has been fixed, a paper output platform 152, on which the recording media 114 are stacked, and a paper output chain 154 having a plurality of paper output grippers, which is spanned between a sprocket arranged on the paper output drum 150 and a sprocket arranged above the paper output platform 152.

Next, the structure of the ink ejection heads 136C, 136M, 136Y, 136K, 136R, 136G and 136B disposed in the ink deposition unit 106 is described in detail. The ink ejection heads 136C, 136M, 136Y, 136K, 136R, 136G and 136B have a common structure, and in the following description, these ink ejection heads are represented by an ink ejection head (hereinafter, simply called a "head") denoted with reference numeral 160.

Figure 9A:
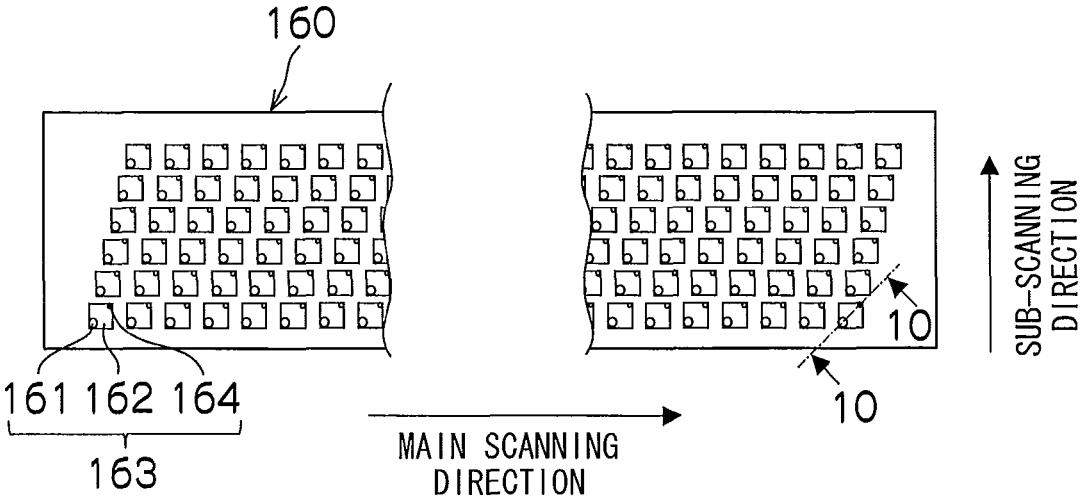
FIGS. 9A to 9C are plan view perspective diagrams showing compositions of inkjet heads.
Figure 9B:
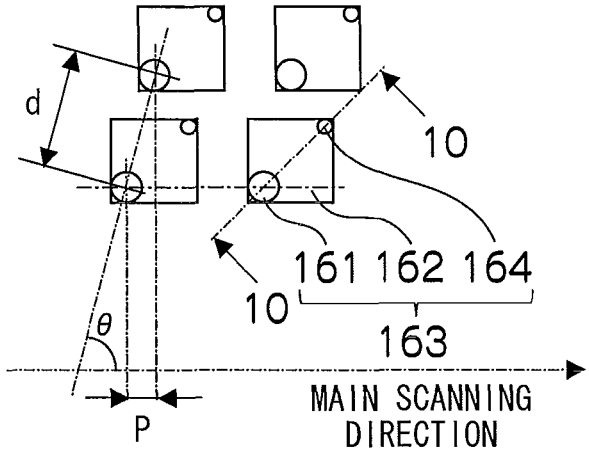
Figure 9C:
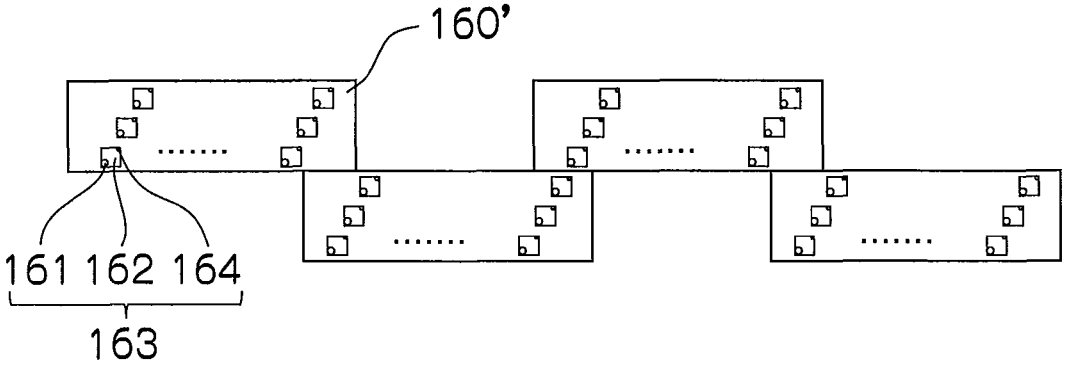
Figure 10:
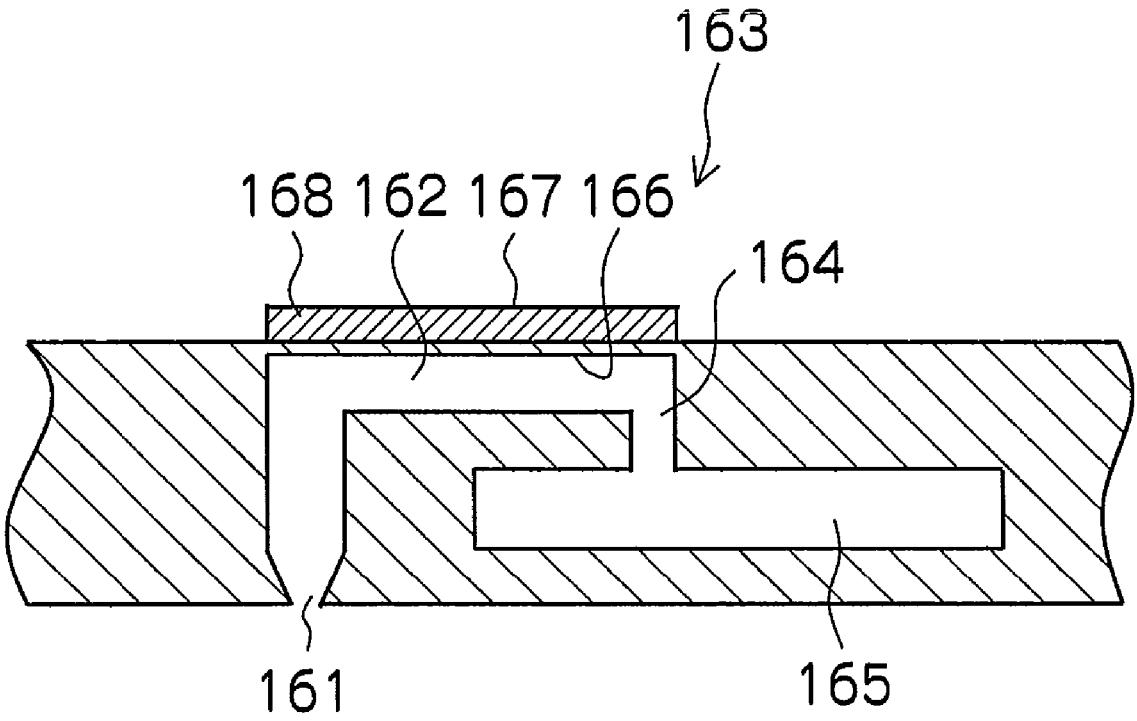
FIG. 10 is a cross-sectional diagram along line 10-10 in FIGS. 9A and 9B.

FIG. 9A is a plan view perspective diagram showing an embodiment of the structure of the head 160; FIG. 9B is an enlarged diagram showing a portion of the head; and FIG. 9C is a plan view perspective diagram showing a further embodiment of the structure of the head 160. FIG. 10 is a cross-sectional diagram along line 10-10 in FIGS. 9A and 9B, and shows the three-dimensional composition of an ink chamber unit.

The nozzle pitch in the head 160 should be minimized in order to maximize the density of the dots formed on the surface of the recording medium 114. As shown in FIGS. 9A and 9B, the head 160 according to the present embodiment has a structure in which a plurality of ink chamber units 163, each having a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction) is reduced and high nozzle density is achieved.

The mode of forming one or more nozzle rows through a length corresponding to the entire width of the recording area of the recording medium 114 in a direction substantially perpendicular to the conveyance direction of the recording medium 114 is not limited to the embodiment described above. For example, instead of the configuration in FIG. 9A, as shown in FIG. 9C, a line head having the nozzle rows of the length corresponding to the entire width of the recording area of the recording medium 114 can be formed by arranging and combining, in a staggered matrix, short head blocks 160' each having a plurality of nozzles 161 arrayed two-dimensionally. Furthermore, although not shown in the drawings, it is also possible to compose a line head by arranging short heads in one row.

The pressure chamber 162 provided corresponding to each of the nozzles 161 is approximately square-shaped in plan view, and the nozzle 161 and a supply port 164 are arranged respectively at corners on a diagonal of the pressure chamber 162. Each pressure chamber 162 is connected through the supply port 164 to a common flow channel 165. The common flow channel 165 is connected to an ink supply tank (not shown), which is a base tank that supplies ink, and the ink supplied from the ink supply tank is delivered through the common flow channel 165 to the pressure chambers 162.

A piezoelectric element 168 provided with an individual electrode 167 is bonded to a diaphragm 166, which forms the upper face of the pressure chamber 162 and also serves as a common electrode, and the piezoelectric element 168 is deformed when a drive voltage is applied to the individual electrode 167, thereby causing the ink to be ejected from the nozzle 161. When the ink is ejected, new ink is supplied to the pressure chamber 162 from the common flow passage 165 through the supply port 164.

In the present embodiment, the piezoelectric element 168 is used as an ink ejection force generating device, which causes the ink to be ejected from the nozzle 160 in the head 161; however, it is also possible to employ a thermal method in which a heater is provided inside the pressure chamber 162 and the ink is ejected by using the pressure of the film boiling action caused by the heating action of this heater.

As shown in FIG. 9B, the high-density nozzle head according to the present embodiment is achieved by arranging the plurality of ink chamber units 163 having the above-described structure in a lattice fashion based on a fixed arrangement pattern, in a row direction that coincides with the main scanning direction, and a column direction that is inclined at a fixed angle of θ with respect to the main scanning direction, rather than being perpendicular to the main scanning direction.

More specifically, by adopting the structure in which the plurality of ink chamber units 163 are arranged at the uniform pitch d in line with the direction forming the angle of θ with respect to the main scanning direction, the pitch P of the nozzles projected so as to align in the main scanning direction is d×cos θ, and hence the nozzles 161 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 114 is moved in the breadthways direction (main scanning direction) of the recording medium 114, thereby performing printing in the breadthways direction, and when one printing action in the breadthways direction has been completed, the recording medium 114 is moved through a prescribed amount in the sub-scanning direction perpendicular to the breadthways direction, printing in the breadthways direction of the recording medium 114 is carried out in the next printing region, and by repeating this sequence, printing is performed over the whole surface of the printing region of the recording medium 114.

Figure 11:
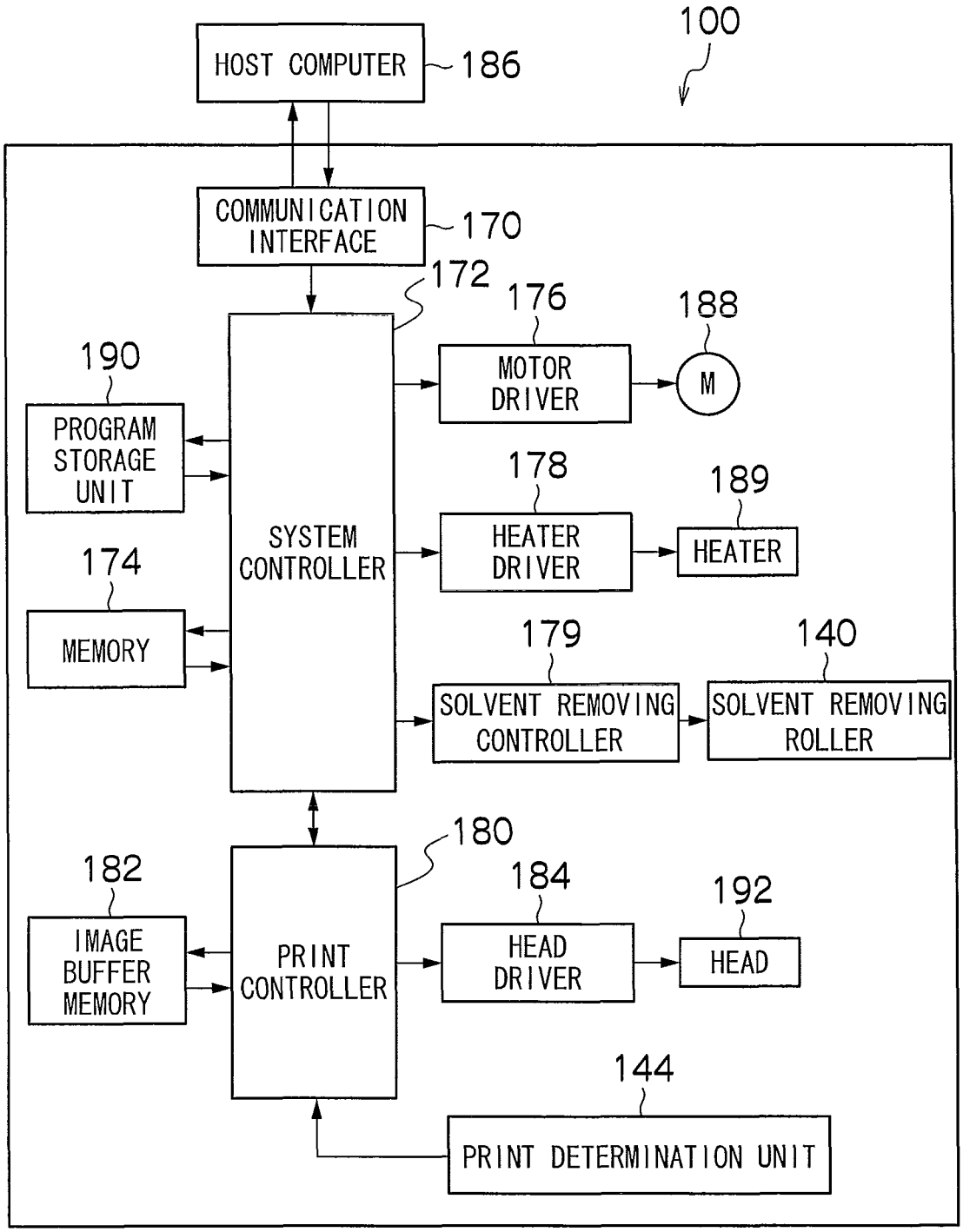
FIG. 11 is a principal block diagram showing a system configuration of the inkjet recording apparatus shown in FIG. 8.

FIG. 11 is a principal block diagram showing the system configuration of the image forming apparatus 100. The image forming apparatus 100 includes a communication interface 170, a system controller 172, a memory 174, a motor driver 176, a heater driver 178, a solvent removing controller 179, a print controller 180, an image buffer memory 182, a head driver 184, a program storage unit 190 and the like.

The communication interface 170 is an interface unit for receiving image data sent from a host computer 186. A serial interface such as USB (Universal Serial Bus), IEEE1394, Ethernet, wireless network, or a parallel interface such as a Centronics interface may be used as the communication interface 170. A buffer memory (not shown) may be mounted in this portion in order to increase the communication speed. The image data sent from the host computer 186 is received by the image forming apparatus 100 through the communication interface 170, and is temporarily stored in the memory 174.

The memory 174 is a storage device for temporarily storing image data inputted through the communication interface 170, and data is written and read to and from the memory 174 through the system controller 172. The memory 174 is not limited to a memory composed of semiconductor elements, and a hard disk drive or another magnetic medium may be used.

The system controller 172 is constituted of a central processing unit (CPU) and peripheral circuits thereof, and the like, and it functions as a control device for controlling the whole of the image forming apparatus 100 in accordance with a prescribed program, as well as a calculation device for performing various calculations. More specifically, the system controller 172 controls the various sections, such as the communication interface 170, memory 174, motor driver 176, heater driver 178, solvent removing controller 179 and the like, as well as controlling communications with the host computer 186 and writing and reading to and from the memory 174, and it also generates control signals for controlling the motor 188 and heater 189 of the conveyance system.

The program executed by the CPU of the system controller 172 and the various types of data which are required for control procedures are stored in the memory 174. The memory 174 may be a non-rewriteable storage device, or it may be a rewriteable storage device, such as an EEPROM. The memory 174 is used as a temporary storage region for the image data, and it is also used as a program development region and a calculation work region for the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not shown).

The motor driver 176 is a driver that drives the motor 188 in accordance with instructions from the system controller 172. In FIG. 11, the plurality of motors (actuators) disposed in the respective sections of the image forming apparatus 100 are represented by the reference numeral 188. For example, the motor 188 shown in FIG. 11 includes the motors that drive the pressure drums 126*a* to 126*d*, the transfer drums 124*a* to 124*d* and the paper output drum 150, shown in FIG. 8.

The heater driver 178 is a driver that drives the heater 189 in accordance with instructions from the system controller 172. In FIG. 11, the plurality of heaters disposed in the image forming apparatus 100 are represented by the reference numeral 189. For example, the heater 189 shown in FIG. 11 includes the heaters of the paper preheating unit 128, the treatment liquid drying unit 132, the hot air drying devices provided in the ink drying units 138, and the like, shown in FIG. 8. In particular, in the present embodiment, the drying conditions in the treatment liquid drying unit 132 are controlled so as to control the distribution of the aggregating agent in the layers of the recording medium when the ink droplets are deposited.

The solvent removing controller 179 controls the nipping pressure (pressing force) and the nipping duration of the solvent removing roller 140 in accordance with instructions from the print controller 180. The most suitable fixing conditions including the nipping pressure and the nipping duration of the solvent removing roller 140 are determined for each of combinations of various types of recording medium 114 and inks, and this information is stored in a prescribed memory (for example, the memory 174) in the form of a data table in advance, in such a manner that the memory is read and the nipping pressure and the nipping duration of the solvent removing roller 140 are controlled accordingly whenever information relating to the recording medium 114 and inks used is acquired.

The print controller 180 is a control unit that has signal processing functions for carrying out processing, correction, and other treatments in order to generate a print control signal on the basis of the image data in the memory 174 in accordance with the control of the system controller 172. The print controller 180 supplies the print data (dot data) thus generated to the head driver 184. Prescribed signal processing is carried out in the print controller 180, and the ejection volume and the ejection timing of the ink droplets in the head 192 are controlled through the head driver 184 on the basis of the image data. By this means, prescribed dot size and dot positions can be achieved. In FIG. 11, the plurality of heads (inkjet heads) disposed in the inkjet recording apparatus 100 are represented by the reference numeral 192, The head 192 shown in FIG. 11 includes the treatment liquid ejection head 130 and the ink ejection heads 136C, 136M, 136Y, 136K, 136R, 136G and 136B shown in FIG. 8. In particular, in the present embodiment, the timing of the ejection of the inks from the ink ejection heads 136C, 136M, 136Y, 136K, 136R, 136G and 136B is controlled so as to control the distribution of the aggregating agent in the layers of the recording medium when the ink droplets are deposited.

The print controller 180 is provided with the image buffer memory 182, and image data, parameters, and other data are temporarily stored in the image buffer memory 182 when image data is processed in the print controller 180. Also possible is an aspect in which the print controller 180 and the system controller 172 are integrated to form a single processor.

The head driver 184 generates drive signals to be applied to the piezoelectric elements 168 of the head 192, on the basis of image data supplied from the print controller 180, and also has drive circuits which drive the piezoelectric elements 168 by applying the drive signals to the piezoelectric elements 168. A feedback control system for maintaining constant drive conditions in the head 192 may be included in the head driver 184 shown in FIG. 11.

The print determination unit 144 is a block that includes the line sensor as described above with reference to FIG. 8, reads the image printed on the recording medium 114, determines the print conditions (presence of the ejection, variation in the dot formation, and the like) by performing desired signal processing, or the like, and provides the determination results of the print conditions to the print controller 180. According to requirements, the print controller 180 makes various corrections with respect to the head 192 on the basis of information obtained from the print determination unit 144.

The operation of the image forming apparatus 100 which has this composition is described below.

The recording medium 114 is conveyed to the feeder board 122 from the paper supply platform 120 of the paper supply unit 102, and is transferred through the transfer drum 124*a* onto the pressure drum 126*a* of the treatment liquid deposition unit 104. The recording medium 114 held on the pressure drum 126*a* is preheated by the paper preheating unit 134 and droplets of the treatment liquid are deposited by the treatment liquid head 130. Next, heating and drying is carried out by the treatment liquid drying unit 132, and the solvent component (mainly water) in the treatment liquid layer formed on the recording medium 114 is evaporated off. The drying conditions are controlled so as to achieve a prescribed distribution of the aggregating agent in the layers of the recording medium 12, when droplets of the ink are deposited on the downstream side. More specifically, the treatment liquid is dried in such a manner that the effective pH of the aggregating agent on the surface of the coating layer of the recording medium 12 when the droplets of ink are deposited is not lower than 1.67 and not higher than 7.0 (in terms of the amount of the aggregating agent, 0 g/m$^2$ or more and 0.1 g/m$^2$ or less), and in such a manner that the effective pH of the aggregating agent inside the coating layer of the recording medium 12 is not lower than 0.1 and not higher than 1.7 (in terms of the amount of the aggregating agent, 0.1 g/m$^2$ or more and 2.0 g/m$^2$ or less).

The recording medium 114 on which the treatment liquid layer (desirably, the solid or semi-solid aggregating treatment agent layer) has been formed is transferred from the pressure drum 126*a* of the treatment liquid deposition unit 104 though the transfer drum 124*b* to the pressure drum 126*b* of the ink deposition unit 106. Droplets of corresponding colored inks are ejected respectively from the ink ejection heads 136C, 136M, 136Y, 136K, 136R, 136G and 136B, onto the recording medium 114 held on the pressure drum 126*b*, in accordance with the input image data.

The control is implemented in such a manner that the effective pH of the aggregating agent on the surface of the coating layer of the recording medium 12 when the droplets of ink are ejected and deposited is 1.67 or higher and 7.0 or lower (in terms of the amount of the aggregating agent, 0 g/m$^2$ or more and 0.1 g/m$^2$ or less), and in such a manner that the effective pH of the aggregating agent inside the coating layer of the recording medium 12 is 0.1 or higher and 1.7 or lower (in terms of the amount of the aggregating agent, 0.1 g/m$^2$ or more and 2.0 g/m$^2$ or less). By ejecting and depositing droplets of the ink in this state, it is possible to ensure spreading of the dots, as well as being able to raise the definition of the image.

After the droplets of the ink are deposited on the recording medium 114, the recording medium 114 held on the pressure drum 126*b* of the ink droplet ejection unit 106 is received on the pressure drum 126*c* of the solvent removal unit 108, via the transfer drum 124*c*. When the recording medium 114 held on the pressure drum 126*c* passes a position opposing the ink drying unit 138, the solvent component (mainly water) in the ink layer on the recording medium 114 is evaporated off by the heating and drying performed by the ink drying unit 138. Moreover, the residual solvent (especially high-boiling-point solvent) remaining on the recording medium 114 is absorbed and removed by the solvent removal roller 140. By this means, it is possible to restrict the amount of water that permeates into the recording medium 114, and therefore it is possible to suppress the occurrence of curl, in addition to which the high-boiling-point solvent is removed from the recording medium 114 and therefore it is possible to prevent blocking of the recording medium 114.

The recording medium 114 on which the solvent components have been removed from the ink layer is transferred from the pressure drum 126*c* of the solvent removing unit 108 through the transfer drum 124*d* to the pressure drum 126*d* of the fixing unit 110. The print results produced by the ink deposition unit 106 on the recording medium 114 held on the pressure drum 126*d* are read in by the print determination unit 144, whereupon the recording medium 114 is heated and pressed by the heating rollers 148*a* and 148*b* to fix the image formed on the recording medium 114.

Then, the recording medium 114 on which the image has been fixed is transferred from the pressure drum 126*d* to the paper output drum 150. The recording medium 114 is then conveyed onto the paper output platform 152 by the paper output chain 154, and is stacked on the paper output platform 152.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording method, comprising:

a treatment liquid deposition step of depositing a treatment liquid containing an aggregating agent onto a surface of a coating layer of a coated paper having a base paper layer and the coating layer coating the base paper layer; and an ink deposition step of depositing ink onto the surface of the coating layer on which the treatment liquid has been deposited, wherein in the ink deposition step, the ink is deposited onto the surface of the coating layer in a state where an effective pH of the aggregating agent on the surface of the coating layer is not lower than 1.67 and not higher than 7.0, and an effective pH of the aggregating agent in the coating layer is not lower than 0.1 and not higher than 1.7.

2. The method as defined in claim 1, wherein in the ink deposition step, the ink is deposited onto the surface of the coating layer in a state where an effective pH of the aggregating agent in the base paper layer of the coated paper is not lower than 1.4 and not higher than 7.0.

3. The method as defined in claim 1, further comprising a heating and drying step of heating and drying a solvent of the ink deposited in the ink deposition step.

4. The method as defined in claim 3, further comprising a fixing step of fixing the ink that has been heated and dried in the heating and drying step, onto the coating layer by heat.

5. An inkjet recording method, comprising:

a treatment liquid deposition step of depositing a treatment liquid containing an aggregating agent onto a surface of a coating layer of a coated paper having a base paper layer and the coating layer coating the base paper layer; and an ink deposition step of depositing ink onto the surface of the coating layer on which the treatment liquid has been deposited, wherein in the ink deposition step, the ink is deposited onto the surface of the coating layer in a state where an amount of the aggregating agent on the surface of the coating layer is 0 $g/m^2$ or more and 0.1 $g/m^2$ or less, and an amount of the aggregating agent in the coating layer is 0.1 $g/m^2$ or more and 2.0 $g/m^2$ or less.

6. The inkjet recording method as defined in claim 5, wherein in the ink deposition step, the ink is deposited onto the surface of the coating layer in a state where an amount of the aggregating agent in the base paper layer of the coated paper is 0 $g/m^2$ or more and 0.21 $g/m^2$ or less.

* * * * *